US007631404B2

(12) United States Patent
Scruggs

(10) Patent No.: US 7,631,404 B2
(45) Date of Patent: Dec. 15, 2009

(54) EASY INTER BURIAL CONTAINER

(76) Inventor: Donald Scruggs, 4464 Walnut Ave., Chino, CA (US) 91710

( * ) Notice: Subject to any disclaimer, the term of this patent is extended or adjusted under 35 U.S.C. 154(b) by 455 days.

(21) Appl. No.: 11/477,236

(22) Filed: Jun. 28, 2006

(65) Prior Publication Data

US 2007/0050958 A1 Mar. 8, 2007

(51) Int. Cl.
*A61G 17/00* (2006.01)

(52) U.S. Cl. ..... 27/35; 52/128

(58) Field of Classification Search ..... 27/35, 27/2, 1; 52/128, 133, 136
See application file for complete search history.

(56) References Cited

U.S. PATENT DOCUMENTS 3,188,712 A * 6/1965 Bauermeister ..... 27/6
3,581,452 A * 6/1971 Jalbert ..... 52/133
3,681,820 A * 8/1972 Jalbert ..... 27/7
3,898,718 A * 8/1975 Eubank ..... 27/35
3,918,133 A * 11/1975 Schmitz ..... 27/2
3,940,894 A * 3/1976 Nunes ..... 52/129
4,328,606 A * 5/1982 Nunes ..... 27/35
4,893,385 A * 1/1990 Schrag ..... 27/35
5,127,112 A * 7/1992 Brock ..... 27/1
7,127,783 B1 * 10/2006 Poole et al. ..... 27/1
2002/0144383 A1 * 10/2002 Spence ..... 27/35

* cited by examiner

*Primary Examiner*—William L. Miller

(57) ABSTRACT

A series of burial containers which can be pressed, agitated, screwed and or self bored into a receiving material and provide low cost interment methods. The burial containers being provided with hermetic sealing, security locking, plaque and memorial markers and built in flower and flag receptacles. They greatly reduce excavation labor and burial costs while providing the respectful funeral services currently practiced. They also decrease the land space required for each burial and provide for burials in normally unused areas within the cemetery, greatly increasing the number of burials possible in each cemetery.

6 Claims, 19 Drawing Sheets

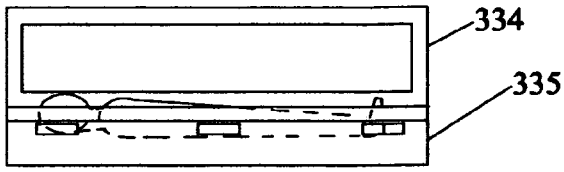
Fig 93
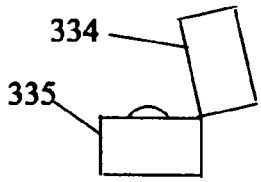
Fig 94
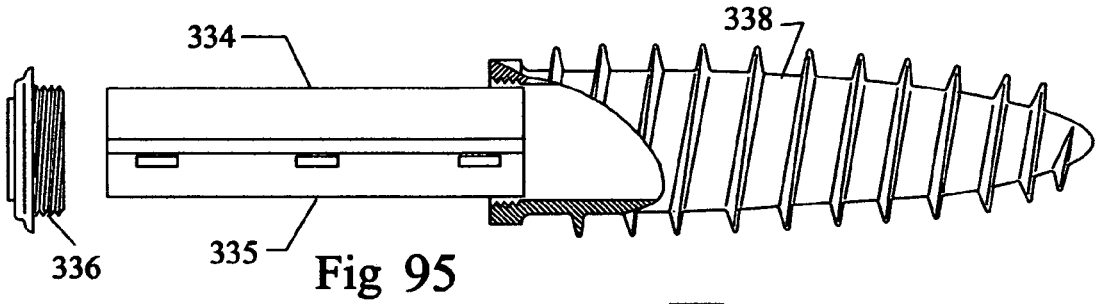
Fig 95
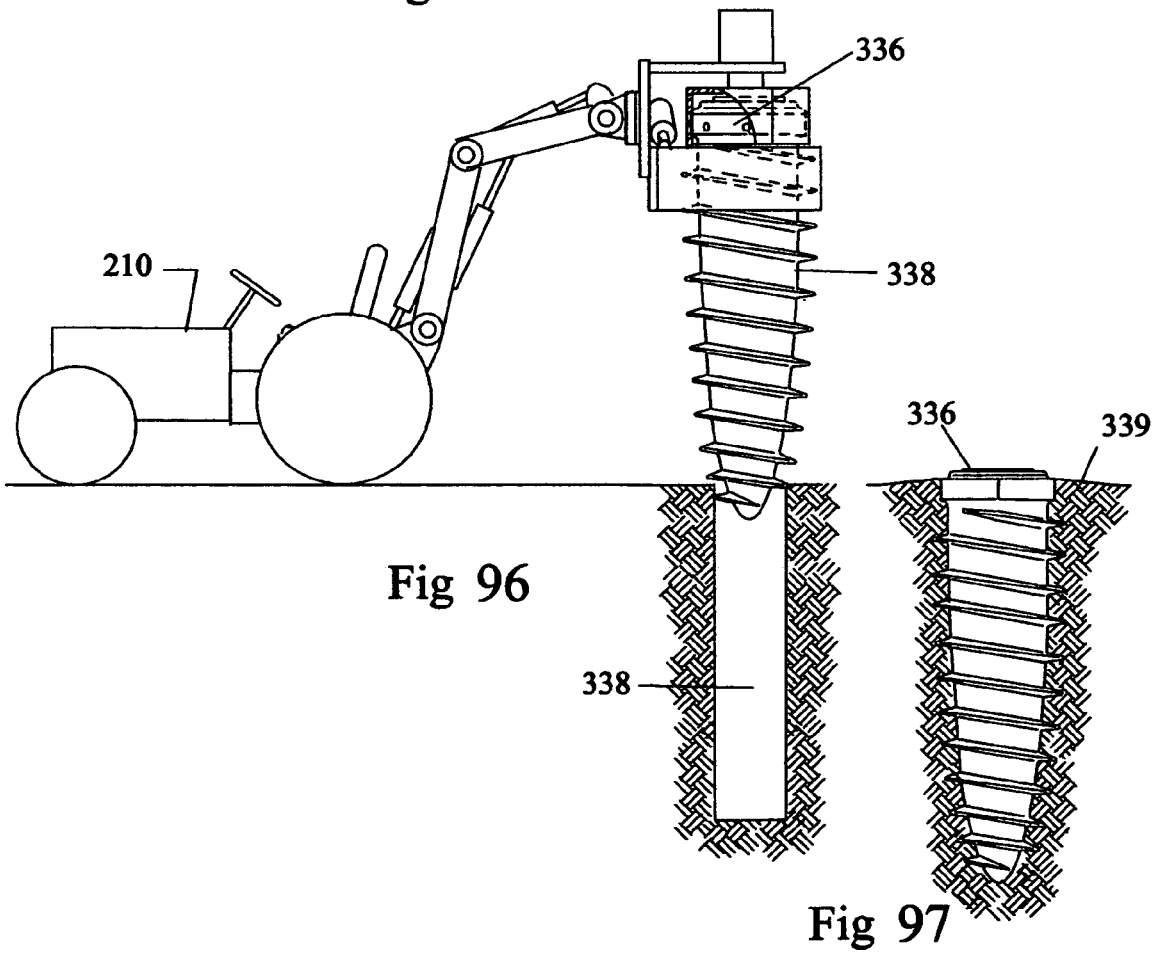
Fig 96
Fig 97

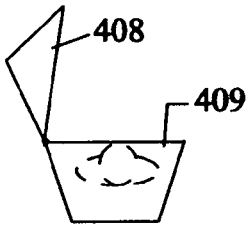
Fig 131
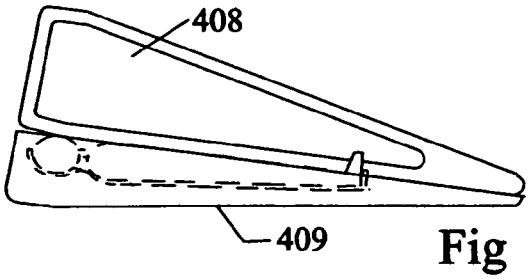
Fig 132
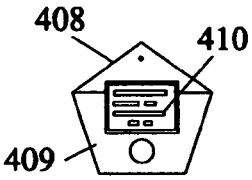
Fig 133
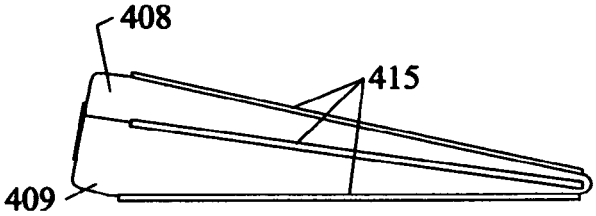
Fig 134
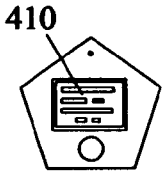
Fig 135
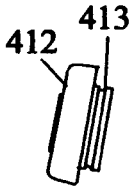
Fig 136
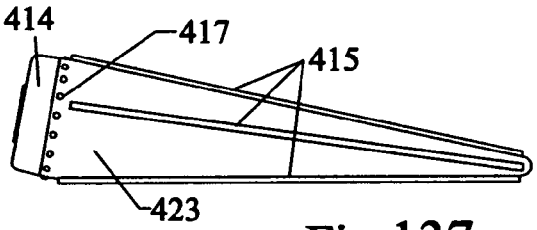
Fig 137
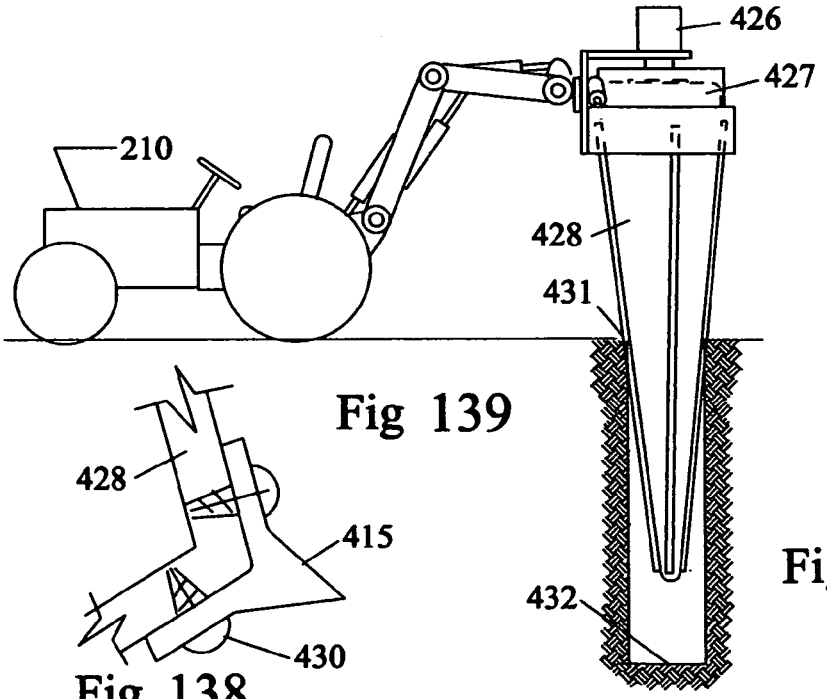
Fig 139
Fig 138
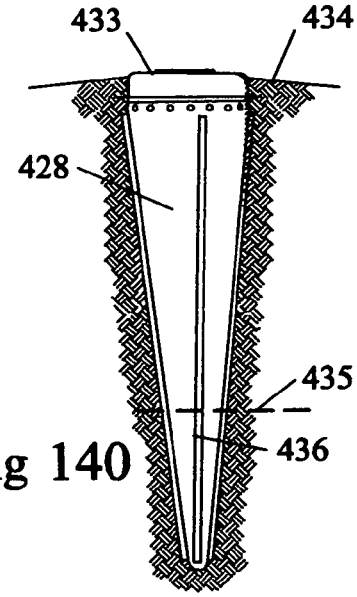
Fig 140

EASY INTER BURIAL CONTAINER

CROSS-REFERENCE TO RELATED APPLICATIONS

Not Applicable

FEDERALLY SPONSORED RESEARCH

Not Applicable

SEQUENCE LISTING OR PROGRAM

Not Applicable

FIELD OF THE INVENTION

This invention relates to conserving land area and easy to install burial containers which can be pressed, agitated, screwed, self bored or by other means set into earth or other receiving materials and do not require a large amount of land area or a large pre-dug rectangular hole with subsequent refilling after the placement of the burial container.

BACKGROUND OF THE INVENTION

A common current interment practice is to first move a body to a mortuary where it is prepared for funeral services. In cases where a body is unclaimed, it is usually provided with minimum preparation and burial, paid for by public finds. A claimed body, after mortuary preparation, is usually placed in an ascetically pleasing casket and either displayed in an open casket funeral service or the casket alone is visible in a closed casket service. Often, after an indoor service the body and casket are moved to a prepared grave site in a cemetery, where a final service is performed.

At the prepared grave site the casket containing the body is set either on or in a box like crypt during a grave side funeral service, if one is conducted. None of these burial services need be changed for the use of an Easy Inter Burial Container. Several types of Easy Inter Burial Containers are designed to be set on a floral or otherwise decorated box for open or closed casket funeral services in an in door or out door environment.

Currently the prepared grave is often a rectangular excavation approximately four feet wide by seven and a half feet long by six and a half feet deep. Walkways are left on all sides of the grave for later visitors, making a total of over 50 square feet of ground area to be set aside for each grave. The Easy Inter Burial Container method requires only about one third of the land area used for current burials.

The removed earth or other receiving material from the current-type grave excavation is usually piled next to the grave site and covered during a grave side funeral service, if one is conducted. After funeral services, the casket and or box like crypt are lowered to the bottom of the prepared grave excavation and the removed receiving material is shoveled back into the excavation. In a Easy Inter Burial Container interment there is not the large volume of earth or receiving material to dig out and later replace, as from a current type grave excavation.

In current type burials, the removed receiving material is replaced and continuously tamped to slightly above the ground level of the excavation to reduce later settling and the showing of a depression. The extra material, left over because of the displacement of the coffin and or box like crypt, is hauled away. Ground cover, such as grass, is then restored over the site. In an Easy Inter Burial Container burial, the receiving material from a relatively smaller hole is all that is left over and can be easily removed or scattered lightly over the surrounding area.

In current type burials, additional digging and preparation is often undertaken to provide for the installation of a headstone, plaque marker or monument and the installation of flower and flag receptacles for persons to later pay respects and honor the deceased. Provisions for plaques, markers, monuments, flower receptacles and flag receptacles are regularly built into Easy Inter Burial Containers. With an eye to future grave site maintenance, a number of tops and end pieces, which will show at the grave site, are made very low to insure power mower clearance and some even have small channels around their outside edges for weed killer to mitigate the normal encroachment of the cemetery's ground cover.

Cemetery properties are usually selected and developed in costly, but pleasant areas with level and softer earth or other receiving materials. Roads, landscaping, fences, monuments, statues, trees, ponds and other items are added for utility and aesthetics. The cost of each grave site, and thus each burial, is relative to the number of grave sites on the developed cemetery property. The future business of a cemetery is based not only on maintenance of filled graves, but on the number of empty grave sites remaining within the cemetery. With the Easy Inter Burial Container method a cemetery has about three times the potential grave sites as in current practice. In addition Easy Inter Burial Containers can be readily installed in ponds, steeply sloped land and very near to trees, adding greatly to the available grave site total in a cemetery.

The labor currently required to prepare a grave, perform a burial and return a site to a finished condition adds significantly to the high cost of each burial. The Easy Inter Burial Container method eliminates the need for a large rectangular excavation, the extensive subsequent refilling, and the later excavation for installation of grave markers and plaques.

It should be noted here that many cemeteries are discouraging the erection of monuments which rise above ground cover level, because of the difficulty of mowing around them with the presently used large power mowers. These cemeteries usually charge more for a grave site with a monument, with the additional amount going into the ongoing maintenance fund.

All in all, the Easy Inter Burial Container method significantly reduces the cost of each grave site and each burial and approximately triple the business potential for each existing and new cemetery.

SUMMARY OF THE INVENTION

It is a main object of this invention to greatly reduce the cost of each grave site by significantly reducing the land area required for each burial.

It is another object of this invention to reduce the cost of a burial by significantly reducing the amount of excavation and replacement of the receiving material and ground cover replanting for each burial.

It is an object of this invention to greatly reduce the secondary labor currently required to finish a grave site after interment by providing for plaque, monument, flag and flower placement as an integral part of the burial container.

An additional object of the invention is to provide for the use of less expensive land for grave sites by providing a means to inter bodies in horizontal, sloping or near vertical land surfaces not currently used.

Another object of the subject invention is to provide a means to more easily inter bodies under water, especially in shallow, tranquil ponds and lakes.

A further object of the invention is to greatly reduce walking on existing graves by persons visiting a cemetery.

And yet an additional object of the invention is to provide an easy method by which to inter pets and appropriately mark the site.

It is still another object of this invention to provide a means to disinter a body without extensive re-excavation of the original grave.

It is an additional object of this invention to provide a means to quickly and easily lodge materials under earth, ground, sand or other receiving material surfaces in such a manner as to be hidden, but easily accessible to certain parties knowing the location.

BRIEF DESCRIPTION OF THE DRAWINGS

FIGS. 1-140 show various elements and views of the burial container.

DETAILED DESCRIPTION OF THE PREFERRED EMBODIMENT

Although the preferred embodiment of this invention is to use a Easy Inter Burial Container with a strong hull, tapered toward the base end, with wide, close spaced threads spiraled around its exterior, a wrench driven opposite end, and power equipment to make the installation, there are numerous alternate variations in design and installation methods shown herein which are required to meet the needs of different environments and social conditions and are entirely within the scope of this invention.

Figure 1:
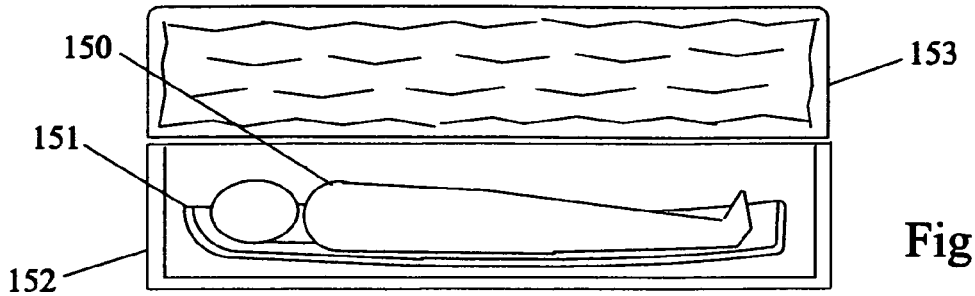

In a primary embodiment of this invention, following mortuary preparations, the body, FIG. 1, 150, is placed in a cloth covered padded and pillowed body tray, 151, which is made to fit the shape of a body as well as the inside of a externally threaded screw in type Easy Inter Burial Container. The body and body tray are temporarily placed inside a lavish display casket, 152, shown in FIG. 1 with its lid, 153, in the open position, for an open casket funeral service. The lavish casket is not buried with the body.

After a funeral service the body and tray are enclosed within a sturdy shroud, 155, which is securely attached to the tray, 151, thus holding the body firmly in the tray. The tray, body and shroud are then placed into a Easy Inter Burial Container hull, 154.

A sealing gasket, 157, (FIGS. 4 & 5) is fixed in place and which ever type of top is used is screwed or set into or onto the Easy Inter Burial Container hull, 154, and secured in place. If a screw in or screw on top is used, the direction of the threads of the top or cap, 149, FIG. 3, must match the direction of the hull's exterior threads, 160, FIGS. 5 and 6, or fins, 192, FIG. 20 and or 197, FIG. 23, on the outside of the Easy Inter Burial Container. This ensures that the top tightens rather than loosens during the installation process.

Thread matching is not required if the top is pressed over or into the Easy Inter Burial Container hull and is fastened to the hull with cement, bars, bolts or other devices of sufficient strength to prevent the top from turning during the screw in or the press in and agitate installation process of several types of Easy Inter Burial Containers.

As can be noted by the figures illustrated herein, the top cap and the top portion of screw in type Easy Inter Burial Containers with screw in or on top caps are made with a number of different internal and external configurations to be handled by an agitating and or turning devices. In some of this type of Easy Inter Burial Containers, lands are formed on the top itself or on the upper portion of the hulls to facilitate the action necessary to cause it to force its way into the earth, sand, soil or other receiving material. Other configurations of this type include placing a bar or bars through the top or the upper portion of the Easy Inter Burial Container to be used to rotate, agitate, press or otherwise handle the container for installation.

Many of the different configurations of tops, top surfaces and upper portions of container hulls have built in receptacles for markers, plaques, flowers and flag poles. High rising plaques, markers or monuments, such as 208 in FIG. 24, which are currently discouraged by an increasing number of cemeteries because they create later mowing and maintenance problems, also create installation problems, but are easily handled by Easy Inter Burial Container methods. The wrenching or gripping device used for container installation into the receiving material is made to reach over, around or from the side to make the installation. An alternative is to only attach the hardware to the top or end section and attach the plaque, marker or monument to the hardware after installation of the Easy Inter Burial Container into the receiving material.

Other similar items can be installed after installation of a Easy Inter Burial Container by drilling into the top and attaching these items or by removing the top and attaching the plaque, marker or monument through the top. An optional methods is to use a deep reaching wench or gripping device which reaches over the monument or plaque and attaches to the top driven surfaces of the Easy Inter Burial Container.

Figure 4:
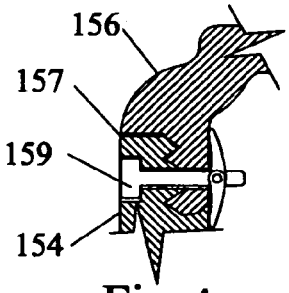

Removing the top after this type of screw in Easy Inter Burial Container is in place in the receiving material requires the removal of any top securing devices such as shown as item 160, FIG. 4. Such securing devices are currently used on items such as automotive wheel lug nuts to deter theft. One such securing device consists of a bolt with a locking head screwed through a preset hollow nut, sometimes called a tube-nut, placed on the inside of the Easy Inter Burial Container, immediately above the top threads. The bolts interfere with the top threads and prevent the top from being turned for removal.

If markers or monuments are installed on this type of Easy Inter Burial Container, removal of the top requires the use of a deep socket wrench device which fits over the attached plaque, marker or monument and satisfactorily engages the flat lands or bosses made to receive and be rotated by the wrench. As an alternative to the socket wrench device, a flat wrench fitting the flat lands or bosses on the screw in or on top or upper portion can be used to rotate and extract a externally screw threaded or angled fin Easy Inter Burial Container.

Figure 28:
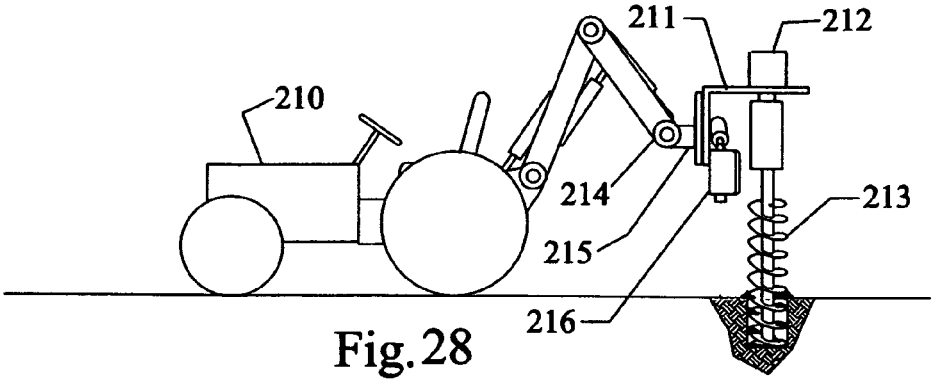

To prepare a grave site for this screw in type of Easy Inter Burial Container installation, a drilling auger, such as those commonly used on a power-take-off attached on the working arm of a tractor backhoe, is used to bore a pilot hole in the direction of the intended Easy Inter Burial Container installation (See FIG. 28). The depth of this hole is usually about half the length of the Easy Inter Burial Container and approximately half its diameter, depending upon the type and condition of the earth or receiving material in which the burial is to be made. Adding an amount of water to the hole aids in causing the earth or receiving material to displace and more readily pack around the Easy Inter Burial Container as well as helps lubricate the passage of the hull and threads or fins during installation.

The external threads or fins on this type of Easy Inter Burial Container are made to be open pitch for more rapid installation into softer, more easily displaced receiving material, such as sandy soil, or more closely spaced for firmer, more resistant receiving materials, such as higher clay content soils. Hull external threads are also made continuous or intermittent with double lead and in left and right hand configuration, while hull fins are directed left or right and angled shallow or deep, depending upon the conditions of the receiving material into which the Easy Inter Burial Container is to be installed.

The hole digging auger, 213, FIG. 28, is removed from the power output shaft on the end of the arm on the tractor backhoe and two other common pieces of hardware are attached. The uppermost attachment is a socket wrench tool, 217, FIG. 29, the shaft of which is fitted to the same power output shaft as that used by the formerly installed hole digging auger, 213, FIG. 28. The lower end of the socket wrench tool, 217, FIG. 29, fits the flats, lands, bosses or other driven members of this type of Easy Inter Burial Container top or the upper portion of a main hull of this type of Easy Inter Burial Container.

The second powered tool, attached below the socket wrench tool, to the end of the tractor backhoe arm, is a commonly used drum or barrel handling grab-and-rotate device. The tractor backhoe manipulates its arm end rotator, 215, (FIG. 30), with the two attached tools, to a position over and around the top of this type of Easy Inter Burial Container. Once the socket wrench tool is properly fitted onto or into the driven shape of the top or the upper portion of the hull of a Easy Inter Burial Container, the barrel grab-and-rotate unit, 216, is tightened around the Easy Inter Burial Container, 218.

This type of screw in Easy Inter Burial Container is then moved to the augered pilot hole, positioned to align its tapered end with the hole and pushed into the hole. The shaft of the drive motor, 212, is activated to turn the socket wrench, 217, in the proper direction to cause the Easy Inter Burial Container to turn its way in a screw like fashion into the receiving material (See FIG. 31). Water may be added to the hole to soften the receiving material and assist the passage of the threads or fins and the hull. Should the receiving material be of a harder or more dense material than expected, a drilling nose can be attached to assist installation. (See 199, FIG. 23.)

As the Easy Inter Burial Container is turned, the threads or fins pull it into the receiving material, following the line of the hole, and the material around the hole is forced outward, causing compaction of the receiving material and creating a tight fit around the Easy Inter Burial Container. A small amount of displacement and uplifting occurs around the top of a Easy Inter Burial Container as it nears the surface of the receiving material.

Figure 24:
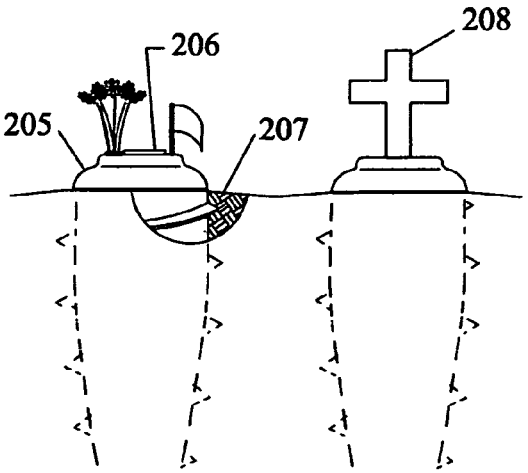
Figure 25:
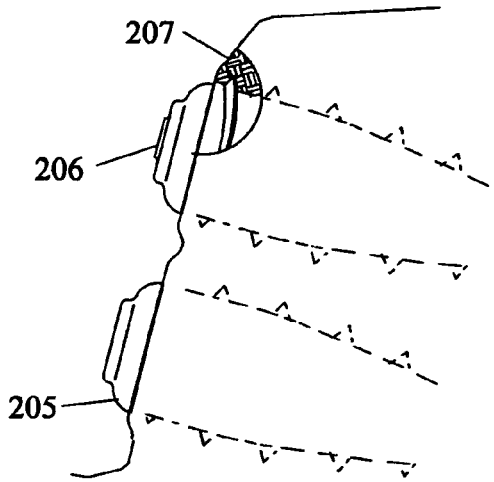
Figure 26:
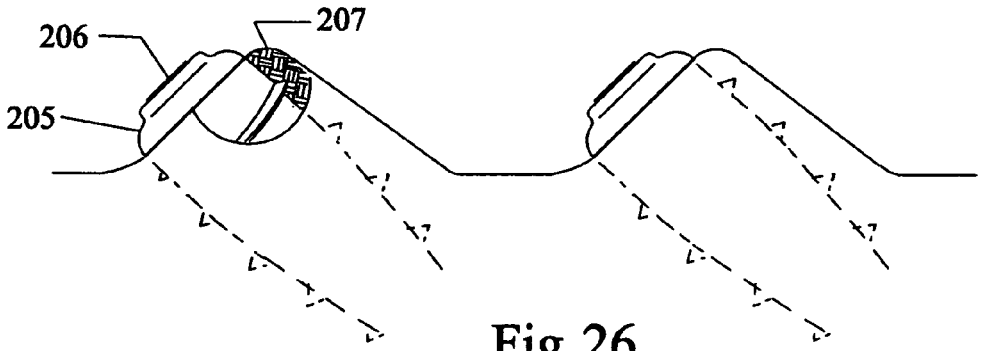

This displacement causes a gradual rise of the receiving material from somewhere outside the Easy Inter Burial Container up to the container itself (See FIGS. 24, 25 and 26). This rise does not usually interfere with power mowing and adds a pleasant effect around the top of the Easy Inter Burial Container. If the area where the Easy Inter Burial Container is installed, is covered with grass, or other such ground cover, the grass or ground cover is usually just pushed outward and up and covers the slight rise and only minimum labor is required to even it out.

A less sophisticated, but effective embodiment of this invention is to use manual labor to install a screw in type Easy Inter Burial Container. The body handling and preparation is the same for a manual labor installation as for a power equipment installation.

Once the body has been placed in the Easy Inter Burial Container, the container is sealed and carried to the grave site. At the center of the grave site a two to three foot deep hole, about one to two feet in diameter is dug. A Easy Inter Burial Container of the finned or screw thread type is positioned with its tapered end in the hole and held in place. For small, pet size, Easy Inter Burial Containers of the finned or screw thread type, handles are inserted into the top or the upper portion of the hull or a fabricated socket fitting the driven shape of the top or upper portion of the hull is fitted and the container is screwed into the receiving material to the desired depth. (See FIGS. 44 to 60.)

On child size Easy Inter Burial Containers of this type (see FIG. 45), one or more persons hold the unit in line with the hole, insert handles into the top or the upper portion of the hull or into a fabricated socket which fits the driven shape of the top or upper portion of the hull and the container is screwed into the receiving material to the desired depth. (See FIG. 45.)

On larger finned or screw thread types of manual Easy Inter Burial Container installations, cited herein as preferred embodiment, heavy bands with handle receptacles (See FIGS. 48 and 49) are installed and tightened over bridging sticks (see FIG. 50) on the hull. Handles are fitted into the band receptacles and the unit is lifted into alignment with the pre-dug pilot hole. Several people hold the unit in alignment with the hole while a number of others use the handles fitted into the heavy bands to turn the Easy Inter Burial Container to screw it into the receiving material. As the lowest band nears the surface of the receiving material, it is removed or moved upward and the turning process is continued.

Figure 59:
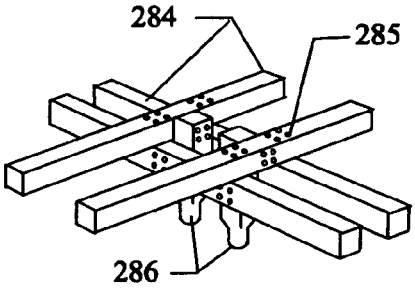
Figure 60:
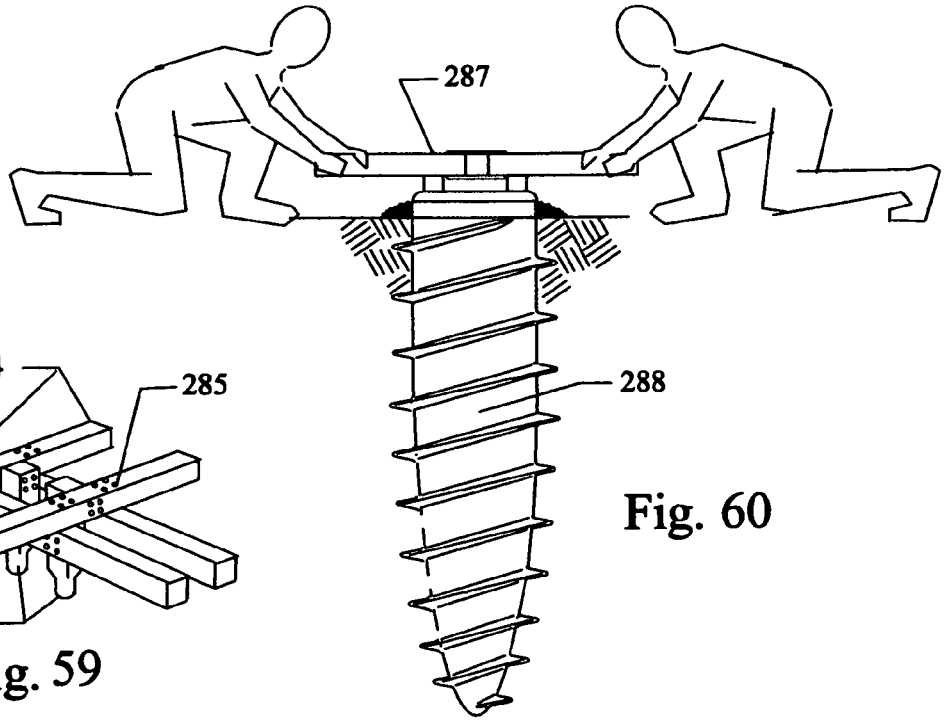

If the persons manually installing this type of Easy Inter Burial Container wish to set the container lower than the height of the last band with handles, and a top is used that does not have handle receptacles, a capstan wheel like device (See FIG. 52), with a wrench made to fit a driven top or the upper portion of a hull (See FIGS. 51, 53, 54, 55 and 56) or a two stud device fitting the flower receptacles of a top (See FIG. 59) is used to additionally turn the unit and set it deeper, as illustrated herein (See FIG. 60). Setting an Easy Inter Burial Container as deep as possible is usually only important when future maintenance of the cemetery includes mowing the grass with power equipment and a near level surface is desired.

Some screw in types of Easy Inter Burial Containers are split lengthwise to act as conventional caskets or coffins during funeral services and some are made with one piece hulls and end caps. Both of these types incorporate continuous or intermittent, close or open spaced, left or right hand external threads around their exterior, depending on the type of soil or receiving material into which they are to be buried. Intermittent threads are much like a series of similarly angled fins which cause the unit to be pulled into the receiving material as it is rotated. There are a number of other ramifications of the invention which accomplish the objectives stated herein.

A basic variation is a Easy Inter Burial Container made to look like a currently used coffin or casket for display of the body during funeral services. After funeral services, the contents are securely retained within the container and a sturdy exterior head piece with provision for marker, plaque, flower and flag receptacles is installed. The entire unit and its contents are lifted by the headpiece and manipulated to effect satisfactory interment into the receiving material. (See FIG. 82.)

A further variation on this design is to attach a pointed nose piece with sharp edges on the opposite end from the head piece and rotate and press the unit into earth or other receiving materials. (See FIG. 90.) This design bores its own final hole for interment.

Another self boring type of Easy Inter Burial Container has screw threads or angled fins, similar to several other designs shown as part of this invention and is split lengthwise in a manner like a current casket or coffin so it can be used in conventional funeral services. It has its screw threads extending outward from the tapered hull to approximately the diameter of the largest end of the Easy Inter Burial Container and has cutting edges on the lower end of these screw threads. The purpose of this configuration is to have it bore its own hole and loosen and re-distributes the earth or receiving material when rotated in the correct direction for installation in a grave site. (See FIGS. 64, 65 and 66.)

A further Easy Inter Burial Container design which self digs is built in several configurations. Some configurations are split lengthwise to be used as display caskets in conventional funeral services while some have a non-split hull with a top similar to several of the screw in Easy Inter Burial Container types shown herein. All of this design have digging blades extending outward from near the bottom of the tapered end of the hull to approximately the diameter of the top of the hull and additional extensions from the cutting blades upward along the side of the hull to cause the loosened earth or other receiving to move upward and out of the hole when the hull is rotated in the correct direction. (See FIGS. 67 and 76.)

A non-self-digging type of Easy Inter Burial Container has a smooth and tapered hull, either split lengthwise like presently used caskets, for current type open casket funerals or is made as a single piece hull with a top. The single piece hull with a top design is used where the body is to be displayed in a show casket and later moved to the Easy Inter Burial Container or a closed casket funeral service is conducted. This design is pressed and occasionally agitated into a pre-dug or bored hole, usually smaller in diameter than the hull.

Several other Easy Inter Burial Container designs used for pressing and agitating into pre-dug or bored holes incorporate protrusions on the lower portion of their hulls to assist in breaking up firmer earth or other receiving materials. This design is also made in a split hull configuration for use in funeral services or is made as a non-split hull with a top, similar to several of the screw in designs. (See FIGS. 108 to 114.)

It should be noted here that the interior of all Easy Inter Burial Container designs are made to fit their intended content, such as a human body, including several made large enough to hold a conventional casket or coffin and yet achieve the advantages of saving cemetery space and burial labor.

A main benefit of this invention is in the conservation of land area usage. It allows far more interments per land area than by current practice, plus it provides a means to inter bodies very near to trees and in ponds and lakes on the cemetery property. Pond and lake grave sites provide a strikingly tranquil and pleasant environment. Easy Inter Burial Containers are used not only vertically, but horizontally or angularly in trench side, hillside or cliff face burials, thus using land space not readily available for burials by current interment means.

The Easy Inter Burial Container method conserves labor by greatly reducing the large size grave excavation and the need to extensively refill and replant as in current burials.

A Easy Inter Burial Container provides for the dignity of a deceased person to stand erect for all time and greatly reduces disrespectful walking on graves by later visitors. The top of the Easy Inter Burial Container with or without its plaque, marker or monument, is visible and the burial itself is directly beneath the top. A top or top cap can be locked securely to the Easy Inter Burial Container, but can be unlocked and opened with the proper tools.

Easy Inter Burial Containers are made using a wide range of materials, such as plastic, cement, concrete, wood, fired clay and metal. Mold formed fiberglass and plastic, cement and concrete are the most common. Optional, but more expensive, methods are forming and carving a Easy Inter Burial Container from wood or machining it from metal. Different materials are used to accomplish different requirements, ranging from the need for very inexpensive burials to elaborately striking and ceremonial burials.

An elaborately striking interment may require a Easy Inter Burial Container of highly polished metal, wood or even clear plastic. A clear plastic Easy Inter Burial Container, where the body is additionally encased in clear resin and is standing erect for all to view during installation, creates a very impressive image.

The majority of equipment used for a Easy Inter Burial Container installation is in common use. Backhoes, tractors, augers and drum or barrel handlers are commonly available. Several easily fabricated vise like gripping devices and socket wrenches welded from plate steel to match the driven portion of Easy Inter Burial Container hulls or tops are all that may be required by the interring cemetery. A cemetery may even do away with the more sophisticated and motorized tools and perform Easy Inter Burials manually.

Another feature of the Easy Inter Burial Container is an option where holes may be provided in the lower portions of the hull to return the body to the earth. The Easy Inter Burial Containers, with security locked tops are also used for multiple interment of ashes.

Should a full disinterment be required, the Easy Inter Burial Container is raised from the receiving material using the same equipment as used for installation. In such disinterments the locking or securing devices are left in place to provide a transfer of force from the gripping or wrenching device to the main hull. Should a minor disinterment be required of a hull and top cap type, such as for DNA sampling or to add ashes of another person or personal effects, the securing devices are removed and only the top is opened.

Easy Inter Burial Containers are also used in ways other than to provide for the burial of human and pet remains. Easy Inter Burial Containers are filled with food, water or other material, securely sealed and quickly installed. An optional installation is to install a through-hull fitting, evacuate the air, refill it with an inert gas, and use it for long term storage. Such containers are easily hidden in most surfaces of the earth and are accessible only to those knowing the location.

Other embodiments, ramifications and combinations of the different designs shown herein for Easy Inter Burial Containers and their interment methods are equally preferred depending upon local conditions and social preferences.

FIG. 1 shows a body, 150, resting in a form fitting body tray, 151, which is set into a lavish casket, 152, with its lid open, 153, for funeral services.

Figure 2:
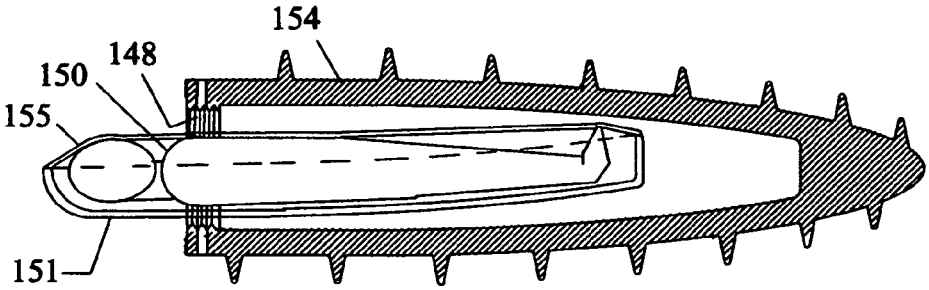

FIG. 2 shows the body tray, 151, with the body, 150, covered with a sturdy retention shroud, 155, which is fastened securely to the body tray, 151, being inserted into a externally threaded screw in type Easy Inter Burial Container hull, 154, shown in cut-away cross section, which has internal threads, 148, to receive the top cap.

Figure 3:
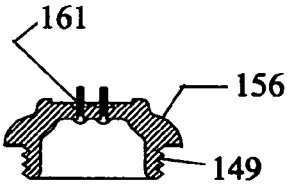
Figure 5:
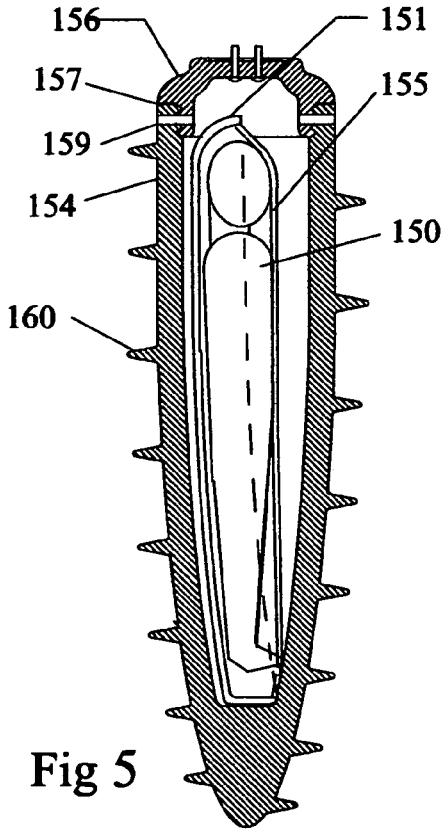

FIG. 3 is a cross section of a screw in top cap for an externally threaded screw in type Easy Inter Burial Container showing how hardware, 161, is set through the top, 156, which fits the Easy Inter Burial Container shown in FIGS. 2 and 5 by way of its threads, 149.

FIG. 4 is an enlarged cut-away view of the joint between a top, 156, and a hull, 154, with a gasket 157, and shows a toggle bolt, 160, used to secure the top from easy removal.

FIG. 5 illustrates a cut away cross section of a screw in type Easy Inter Burial Container in the erect position, with a hull,

154, a form fitting body tray, 151, shroud, 155, body, 150, top cap, 156, gasket, 157, and top cap retaining toggle bolt, 159.

Figure 6:
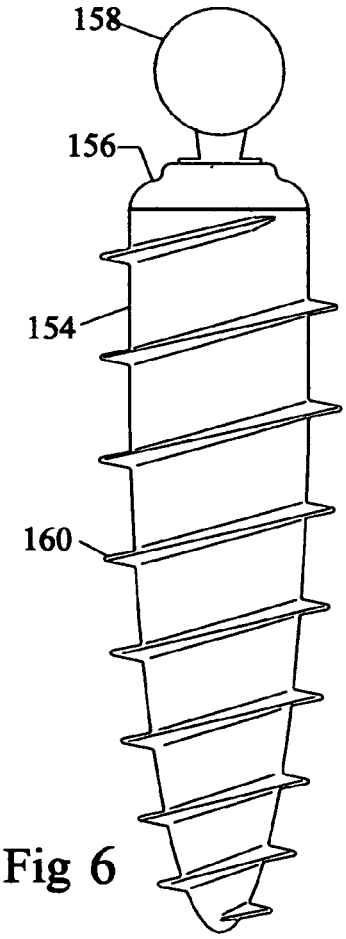

FIG. 6 is a side view of the exterior of the Easy Inter Burial Container shown in FIG. 5, with a monument, 158, installed on the top, 156, a hull, 154, with external threads, 160.

Figure 7:
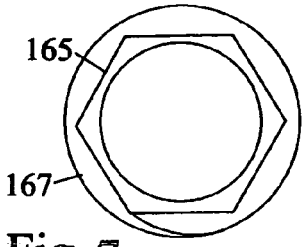
Figure 8:
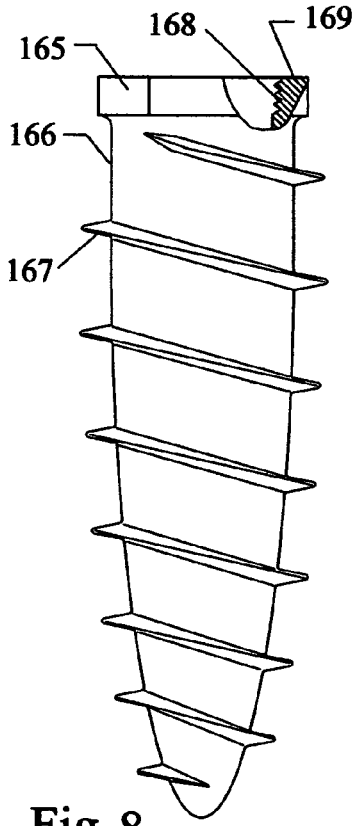

FIG. 7 is a top view of the Easy Inter Burial Container in FIG. 8, showing six lands, 165, on which to fit a wrench and rotate the hull and cause the threads, 167, to pull the Easy Inter Burial Container into the receiving material.

FIG. 8 is a side view of a screw in type Easy Inter Burial Container hull, 166, having open spaced, left hand threads, 167, driven lands, 165, as a part of the upper portion of the hull, 166, with a cut-away section at the upper right, showing a gasket, 169, and internal threads, 168, into which a screw-in top cap, such as those shown in FIGS. 11, 12, 13, 14, 15,16 and 17 may be fitted, provided the threads of the top cap are of the same rotation direction as the external threads, 167, on the outside of the hull, 166.

Figure 9:
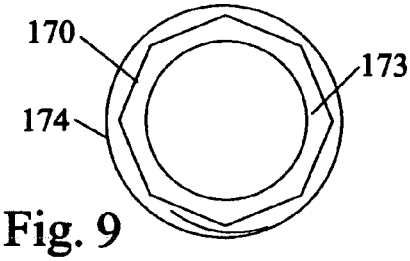
Figure 10:
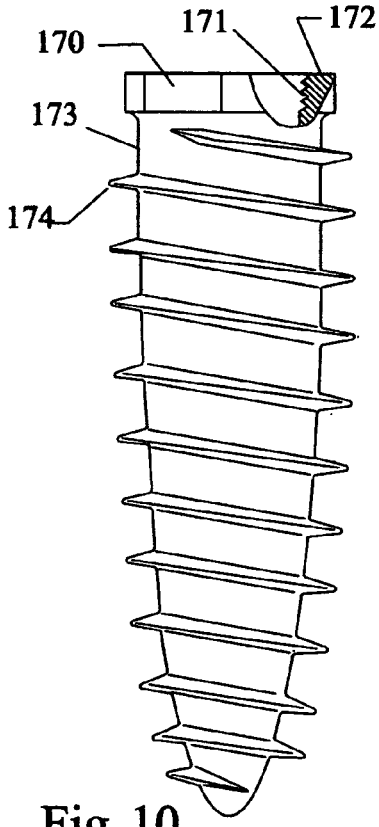

FIG. 9 is a top view of the Easy Inter Burial Container hull in FIG. 10, showing an octagonally shaped set of lands, 170, on the upper portion of the hull, 173, and its external screw in hull threads, 174.

FIG. 10 is a side view of a screw in type Easy Inter Burial Container hull, 173, having close spaced, left hand threads, 174, driving lands, 170, as a part of the upper portion of the hull, with a cut-away section at the upper right, showing the gasket, 172, and the internal threads, 171, into which a screw-in top cap, such as those shown in FIGS. 11, 12, 13, 14, 15,16 and 17 may be fitted, provided the threads of the top are of the same rotation direction as the external threads, 174, on the hull, 173.

Figure 11:
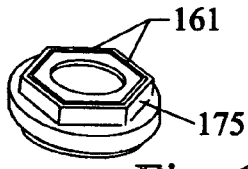

FIG. 11 is an oblique view of a top cap showing a round recess for the attachment of a plaque or marker and a hex shaped series of lands, 175, by which to turn the top and the Easy Inter Burial Container for installation. Also shown is a small channel, 161, around the periphery in which to place weed killer to reduce ground cover encroachment.

Figure 12:
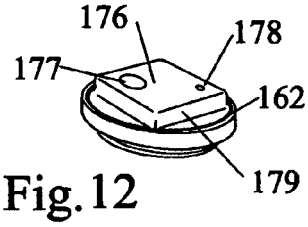

FIG. 12 is an oblique view of a top showing a flat surface, 176, for placement of a plaque or marker, a flower receptacle, 177, a flag pole receptacle, 178, and flat areas forming a square, 179, onto which is fitted a wrench or driver socket to rotate and install the Easy Inter Burial Container in earth or other receiving materials. Also shown is a small channel, 162, around the periphery in which to place weed killer to reduce ground cover encroachment.

Figure 13:
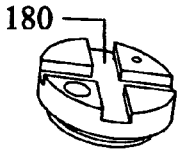

FIG. 13 shows a Easy Inter Burial Container top having a cross shaped recess, 180, which can be used to install the Easy Inter Burial Container, and later receive a plaque, marker or monument, and also having a flower receptacle and flag pole holder.

Figure 14:
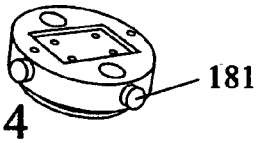

FIG. 14 is an oblique view of a top with a rectangular recess for plaque, marker or monument mounting, flower receptacles and flag pole holes and bosses, 181, for receiving a wrenching device to rotate the Easy Inter Burial Container for its installation.

Figure 15:
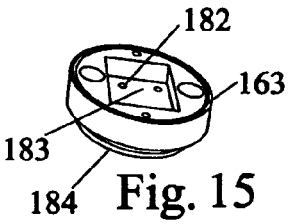

FIG. 15 is an oblique view of a top cap with a square installation recess, 183, which is used later for a plaque or marker, flag pole and flower receptacles, hardware holes, 182, for plaque or monument mounting and also showing the threads, 184, by which it is screwed into a Easy Inter Burial Container hull. Also shown is a small channel, 163, around the periphery in which to place weed killer to reduce ground cover encroachment.

Figure 16:
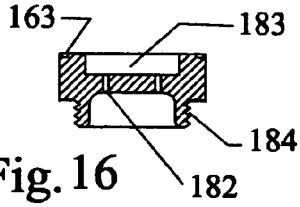

FIG. 16 is a cross section of the Easy Inter Burial Container top cap in FIG. 15, showing its recessed flat area, 183, to receive a plaque or marker, screw-in threads, 184, to fit a Easy Inter Burial Container hull having internal threads, and holes, 182, through which hardware is fitted to attach a plaque, marker or monument. Also shown is a small channel, 163, around the periphery in which to place weed killer to reduce ground cover encroachment.

Figure 17:
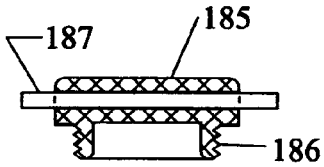

FIG. 17 is a cut-away cross section of a Easy Inter Burial Container top having a flat area, 185, screw in threads, 186, a hole laterally through the top cap, and a bar, 187, fitted through the hole to be used to receive a wrenching device to rotate and install the Easy Inter Burial Container.

Figure 18:
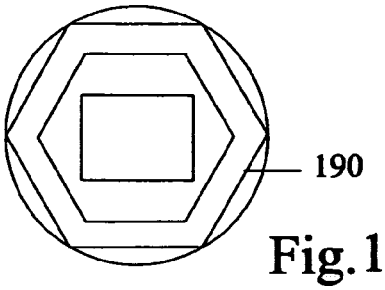
Figure 19:
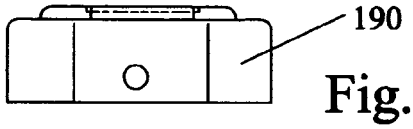

FIG. 18 is a top view of the Easy Inter Burial Container top shown in FIG. 19, illustrating a rectangular recess for a plaque, marker or monument, and showing a hex shaped configuration, 190, of flat lands by which a matching wrenching device is used to turn the Easy Inter Burial Container for installation.

Figure 20:
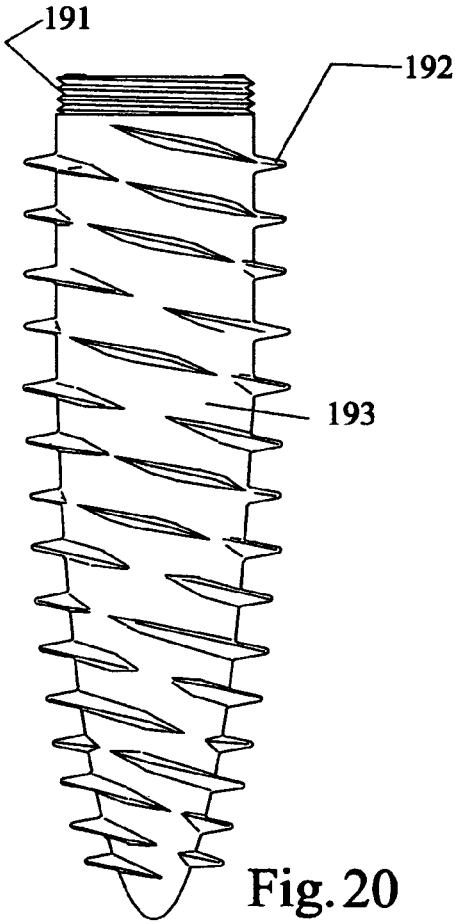

FIG. 19 is a side view of the screw on Easy Inter Burial Container top shown in FIG. 18, having a raised section on which can be mounted a plaque, marker or monument, internal threads to fit a hull as shown in FIG. 20, and showing a hex shaped set of lands, 190, to receive a installation wrenching device.

FIG. 20 is a side view of a Easy Inter Burial Container hull, 193, having external left hand angled fins or intermittent threads, 192, for more retention into the receiving material, and different external left hand threads, 191, at its upper portion, to receive the left hand screw on top shown in FIGS. 18 and 19.

Figure 21:
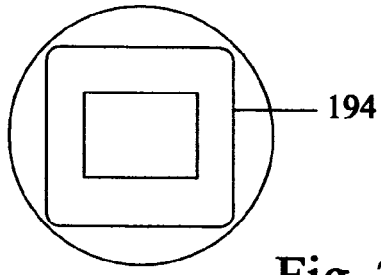
Figure 22:
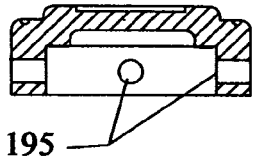

FIG. 21 is a top view of the Easy Inter Burial Container press on top, also shown in FIG. 22, illustrating a rectangular recess for a plaque, marker or monument, and showing a four sided configuration of lands, 194, by which to allow a matching wrench device to turn the top and the screw in type Easy Inter Burial Container for installation.

Figure 23:
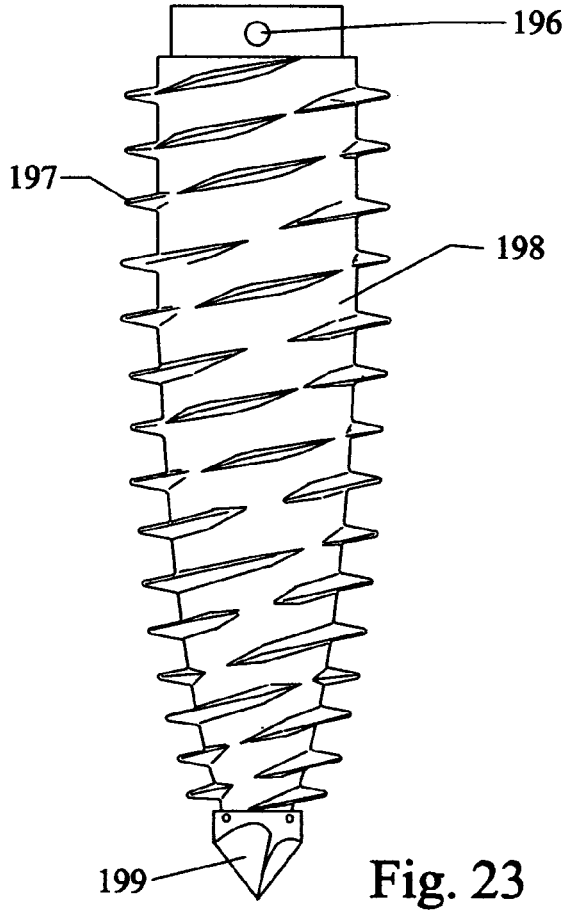

FIG. 22 is a cross section view of a press-on Easy Inter Burial Container top as shown in FIG. 21 having through holes, 195, for insertion of a bar or bars by which to turn the unit and later insert security devices, to fit a Easy Inter Burial Container hull as shown in FIG. 23, and a raised section on which can be mounted a plaque, marker or monument.

FIG. 23 is a side view of a Easy Inter Burial Container hull having right hand intermittent external threads or fins, 197, no top threads, and through holes, 196, directly in the main hull, 198, into which bars are used to turn the unit and later bolts or locks to secure the top, plus an attached auxiliary auger nose, 199, to assist installation into firmer receiving materials.

FIG. 24 illustrates vertical positioning of two externally threaded Easy Inter Burial Containers, with their tops showing, 205, a plaque, 206, attached on the left unit and a cross monument, 208, attached on the right unit, with displaced and raised receiving material, 207, shown in the cut-away cross section.

FIG. 25 illustrates near horizontal positioning of two externally threaded screw in type Easy Inter Burial Container installations in a steep hillside or the sidewall of an embankment or trench, with their tops showing, 205, a plaque, 206, attached on the upper unit with displaced and raised receiving material, 207, shown in the cut-away cross section next to the upper unit.

FIG. 26 illustrates two diagonally installed screw in type Easy Inter Burial Containers, with their tops showing, 205, plaques, 206, attached on both units, with displaced and raised receiving material, 207, shown in the cut-away cross section of the left hand unit.

Figure 27:
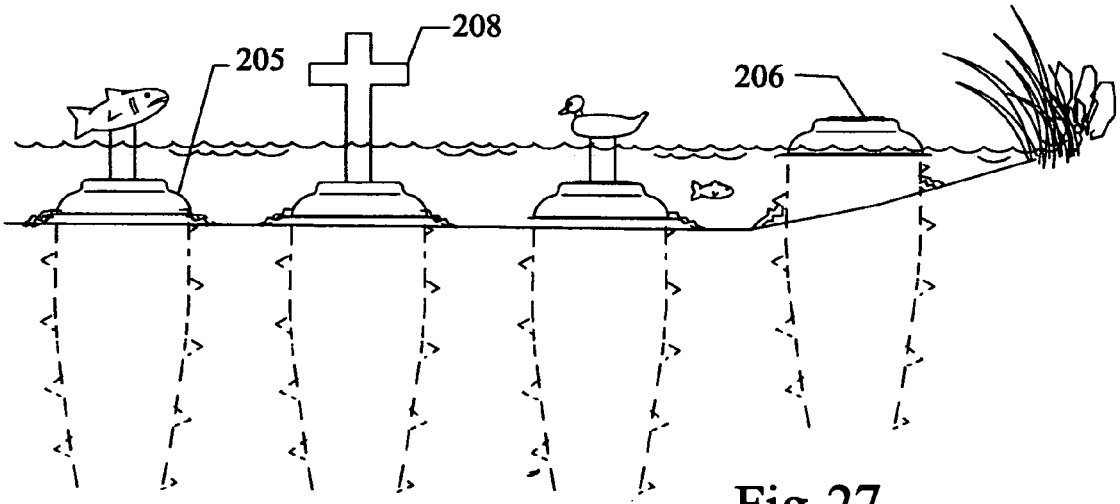

FIG. 27 is a view of four screw in type Easy Inter Burial Containers placed in a shallow water area, such as a pond or lake within a cemetery, with three of the Easy Inter Burial Containers having tops, 205, below the water level and special, topical monuments, such as the cross, 208, showing above the water level and the unit on the right having its top and plaque, 206, above the water level, but still surrounded by water.

FIG. 28 shows how a tractor or backhoe, 210, with a rear mounted work arm having at its end, 214, a rotator, 215, and an angled adaptor, 211, onto which is mounted a hydraulic motor, 212, driving an auger, 213, making a pilot hole and a drum handler, 216, with which to position a Easy Inter Burial Container.

Figure 29:
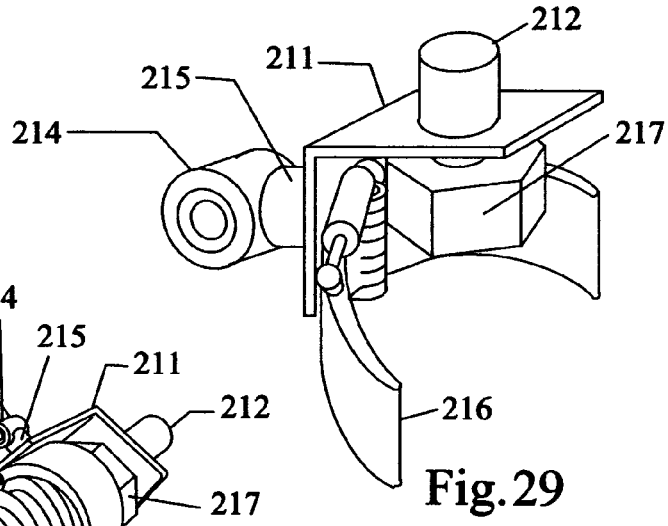

FIG. 29 is an oblique picture of equipment on the end of a tractor backhoe arm as in FIG. 28, showing the angle adaptor, 211, hydraulic motor, 212, barrel drum handler, 216, arm end, 214, rotator, 215, and a socket wrench, 217, to fit the top of a screw in type Easy Inter Burial Container and rotate it for installation.

Figure 30:
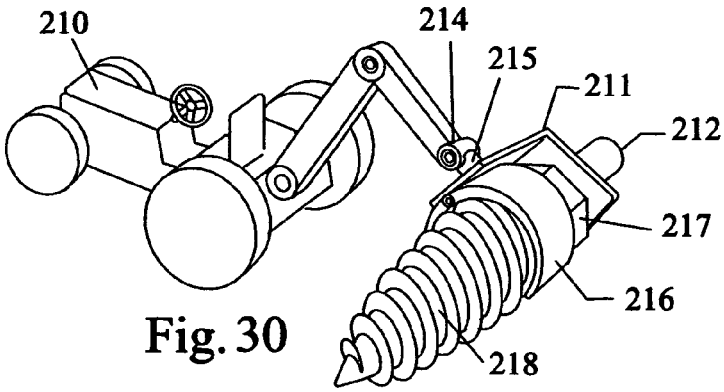

FIG. 30 is an oblique drawing of a tractor backhoe, 210, angled adaptor, 211, hydraulic motor, 212, barrel drum handler, 216, arm end, 214, rotator, 215, socket wrench, 217, with a screw in type Easy Inter Burial Container, 218, being picked up for installation.

Figure 31:
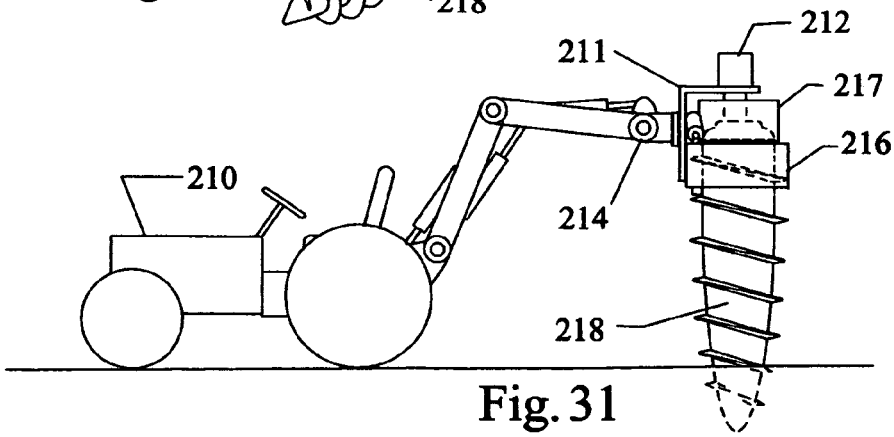

FIG. 31 illustrates the positioning of a tractor backhoe, 210, angled adaptor, 211, barrel drum handler, 216, arm end, 214, socket wrench, 217, and a screw in type Easy Inter Burial Container, 218, fitted into a pilot hole and being rotated by the hydraulic motor, 212, for installation.

Figure 32:
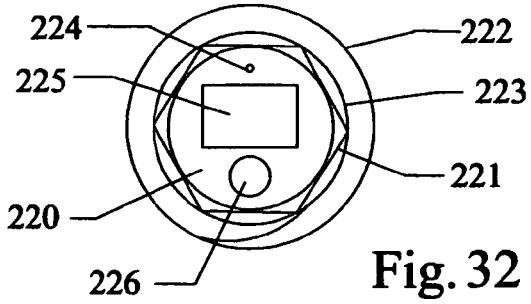
Figure 36:
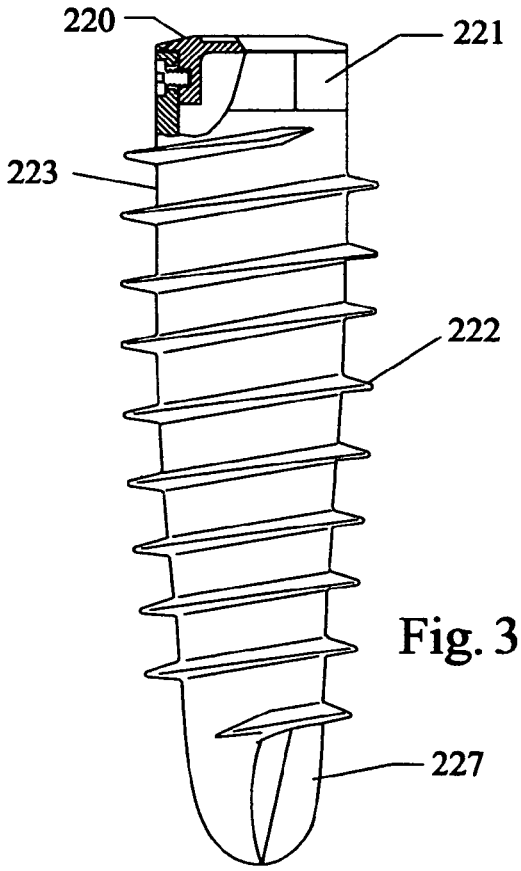

FIG. 32 is a top view of the screw in type Easy Inter Burial Container shown in FIG. 36, with a flag pole receptacle, 224, a flower receptacle, 226, the top itself, 220, one of six flat sections or lands, 221, on the main body by which a wrench, shown elsewhere, will rotate the unit, 223, so that the hull's external screw threads, 222, will pull the container into the receiving material.

Figure 33:
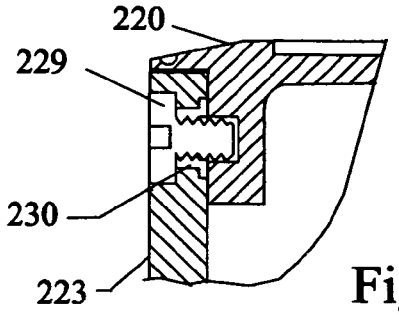

FIG. 33 is an enlarged view of the upper left cut away portion of the drawing in FIG. 36, showing the relationship of the Easy Inter Burial Container top, 220, the main hull, 223 and a tube nut, 230, fitted from the inside, protruding out into the upper rim of the main hull and into which is fitted a flush bolt, 229, to deter the removal of the top.

Figure 34:
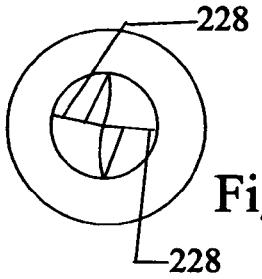

FIG. 34 is a view looking up from below the Easy Inter Burial Container shown in FIG. 36, emphasizing the cutting edges, 228, on the self drilling nose.

Figure 35:
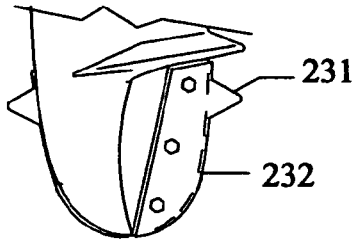

FIG. 35 is a view of only the bottom portion of a Easy Inter Burial Container, such as the one shown in FIG. 36, with cutting plates, 232, bolted to the self drilling cutting edges to facilitate installation into firmer or harder receiving materials and having digging tabs, 231, to break up and loosen the receiving material.

FIG. 36 is a full side view of a screw in type Easy Inter Burial Container with its hull, 223, having flat areas, 221, around its upper portion to receive and be driven by a wrench, shown elsewhere, medium spaced, right hand screw threads, 222, around the hull, 223, a press in top, 220, and a built-in self drilling nose, 228, at the bottom.

Figure 37:
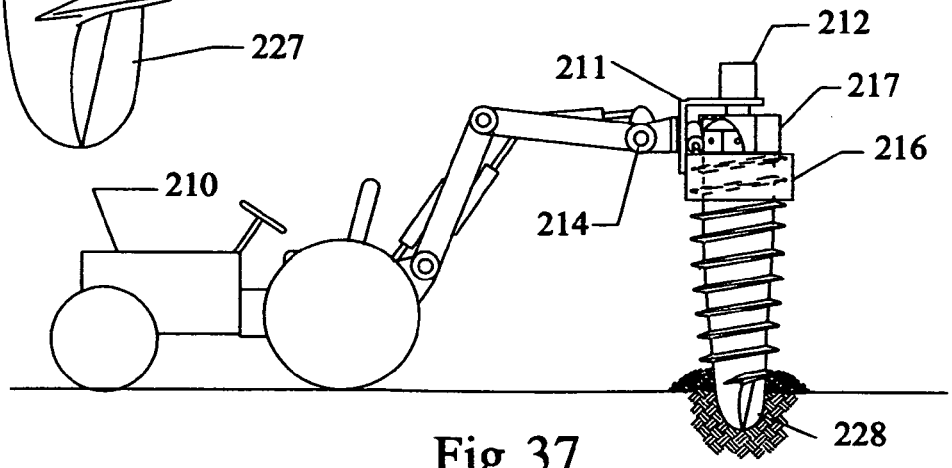

FIG. 37 is a tractor backhoe, 210, with arm end, 214, angled adaptor, 211, hydraulic motor, 212, socket wrench, 217, and barrel drum handler, 216, using a built-in self drilling nose, 228, to bore its own installation pilot hole as the unit is rotated and installed.

Figure 38:
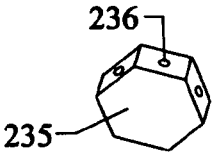
Figure 39:
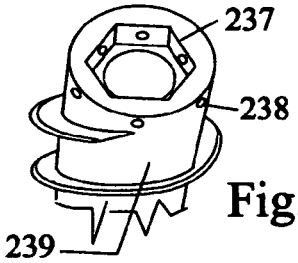

FIG. 38 illustrates a hexagonal shaped top, 235, made to fit into the Easy Inter Burial Container in FIG. 39, with through-holes, 236, aligning with through-holes in the upper portion of the hull shown in FIG. 39.

FIG. 39 is an oblique view of the upper portion of a screw in type Easy Inter Burial Container hull, 239, having a recessed hexagonal shaped section, 237, into which the top in FIG. 38 is fitted, with the through-holes, 238, matching the through holes in the top, 236, FIG. 38, and through which bars or pipes are fitted for turning the unit for installation.

Figure 40:
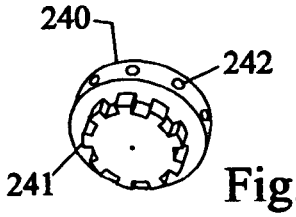
Figure 41:
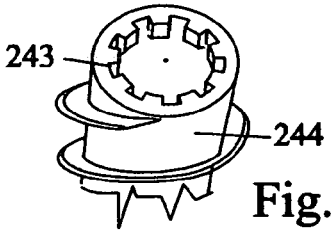

FIG. 40 is a view of the underside of a top, 240, with through-holes, 242, for driver handles and with a series of bosses, 241, matching the recesses in the externally threaded screw in type Easy Inter Burial Container hull in FIG. 41, to transfer the rotational force from the top to the hull when handles are fitted into the top holes and the Easy Inter Burial Container is rotated for installation.

FIG. 41 is an oblique view of the upper portion of a externally threaded screw in type Easy Inter Burial Container hull having recesses, 243, into which the top in FIG. 40 is fitted, and provides the transfer of force from the top to the hull, 244, during installation.

Figure 42:
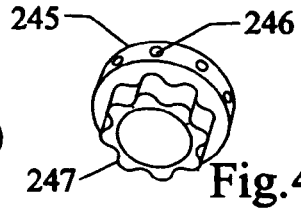
Figure 43:
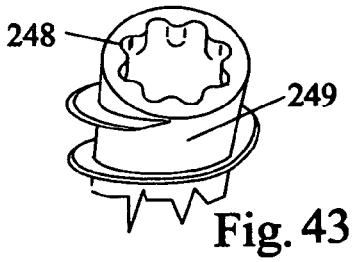

FIG. 42 is a view of a top, 245, with a series of lobes and recesses, 247, matching the lobes and recesses in the Easy Inter Burial Container in FIG. 43 and showing holes, 246, into which handles are fitted to rotate the Easy Inter Burial Container for installation.

FIG. 43 is an oblique view of the upper portion of a externally threaded screw in type Easy Inter Burial Container hull, 249, having lobes and recesses, 248, to match the lobe and recess configuration of the top in FIG. 42 and provide for the transfer of force from that top to the hull, 249, during installation.

Figure 44:
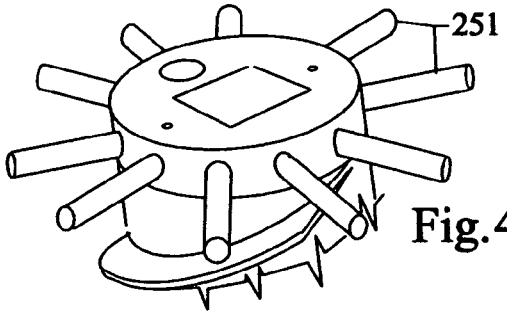

FIG. 44 is a view of the upper portion of a externally threaded screw in type Easy Inter Burial Container with its top in place and having handles, 251, placed into the top holes to allow manual rotation of the container for installation or extraction.

Figure 45:
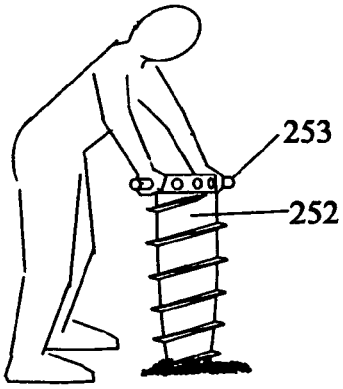

FIG. 45 illustrates a manual turning of a smaller sized externally threaded screw in type hull, 252, by the use of handles, 253, placed in the holes of a smaller sized Easy Inter Burial Container top.

Figure 46:
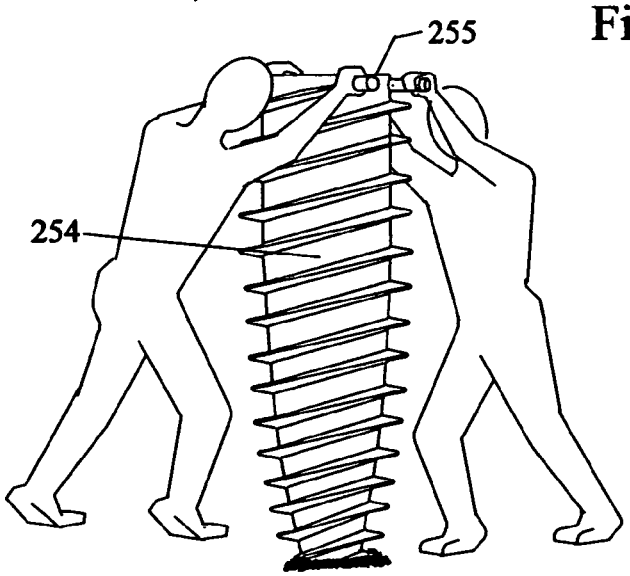

FIG. 46 shows the use of handles, 255, placed into the holes in the upper portion of a externally threaded screw in type Easy Inter Burial Container, 254, to facilitate manual turning of the unit. Note that the hull shown has close spaced external threads providing more downward pressure per revolution.

Figure 47:
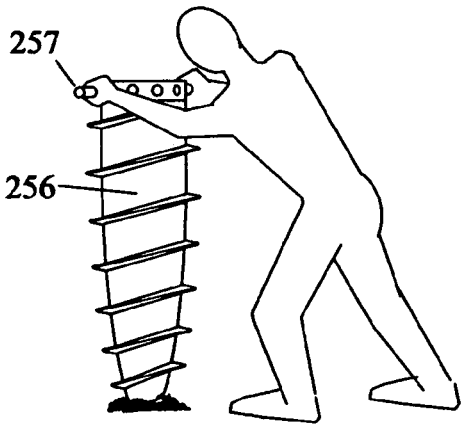

FIG. 47 shows a manual turning and installation of a medium sized screw in type Easy Inter Burial Container by the use of handles, 257, placed into holes in the upper portion of its hull, 256.

Figure 48:
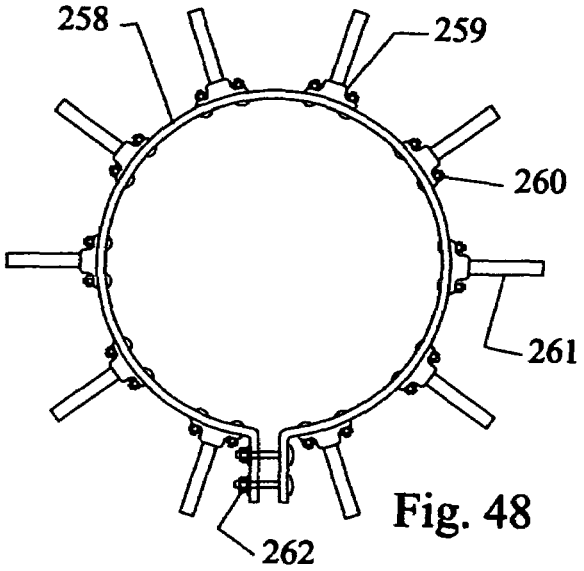

FIG. 48 is a top view of a band, 258, with handle receptacle fittings, 259, attached with hardware, 260, and handles, 261, placed into the fittings, and attachment hardware, 262, installed at the band clamping point, which is placed around the hull of a externally threaded screw in type Easy Inter Burial Container to provide for a number of persons to assist in turning the Easy Inter Burial Container for installation.

Figure 49:
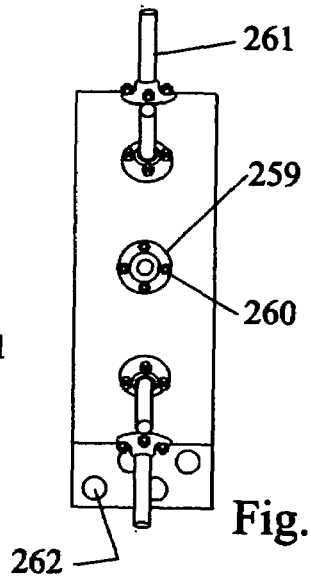

FIG. 49 is a side view of the band in FIG. 48 showing the handles, 261, handle fittings, 259, fitting hardware, 260, and the band clamping hardware, 262.

Figure 50:
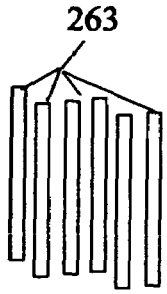

FIG. 50 illustrates a packet of stout sticks, 263, of sufficient length to bridge across several threads or fins of a externally threaded screw in type Easy Inter Burial Container to provide more positive and more level contact between the band shown in FIGS. 48 and 49 and the Easy Inter Burial Container hull.

Figure 51:
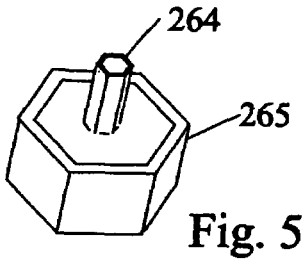

FIG. 51 is an isometric view of a six sided driver wrench, 265, to match the configuration of a six sided top of a screw in type Easy Inter Burial Container and allow it to be rotated by way of the shaft, 264.

Figure 52:
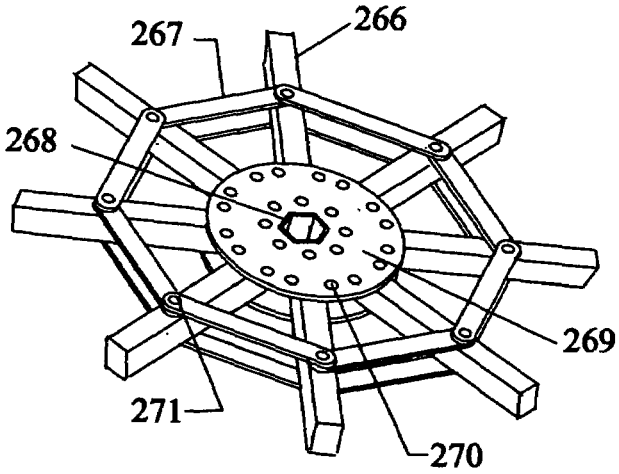

FIG. 52 is an isometric view of a spoked capstan-type driver to be used by several people for manually turning a externally threaded screw in type Easy Inter Burial Container, with handle spokes, 266, braces, 267, a center hex hub, 268, matching the shafts of the drivers shown in FIGS. 51, 53, 54, 55 and 56, center plate, 269, center assembly hardware, 270, holding the handles in place and brace attachment hardware, 271.

Figure 53:
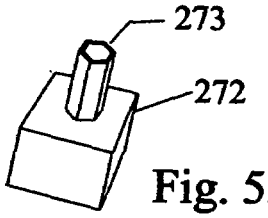

FIG. 53 is an isometric view of a square sided driver wrench, 272, which matches the configuration of a square receptacle in the top of a externally threaded screw in type Easy Inter Burial Container or the upper portion of a Easy Inter Burial Container hull and provides the means for it to be rotated by way of the hexagonal shaft, 273.

Figure 54:
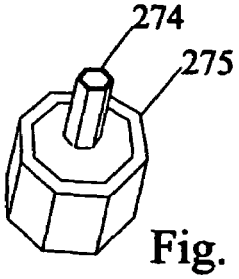

FIG. 54 is an isometric view of a eight sided driver wrench, 275, which matches the configuration of a eight sided receptacle on the top or the upper portion of a externally threaded screw in type Easy Inter Burial Container hull and provides the means for it to be rotated by way of the hexagonal shaft, 274.

Figure 55:
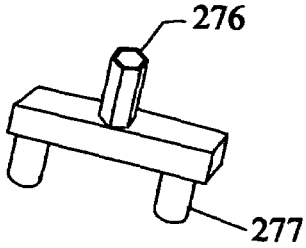

FIG. 55 is an isometric view of a two boss driver wrench, 277, which matches and fits into two flower receptacles in the top of a externally threaded screw in type Easy Inter Burial Container and provides a means for the burial container to be rotated by way of the hexagonal shaft, 276.

Figure 56:
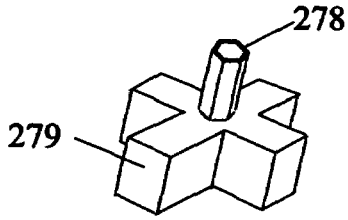

FIG. 56 is an isometric view of a crossed bar driver wrench, 279, which matches the configuration of a screw in type Easy Inter Burial Container top having crossed recesses and provides a means for it to be rotated through the shaft, 278.

Figure 57:
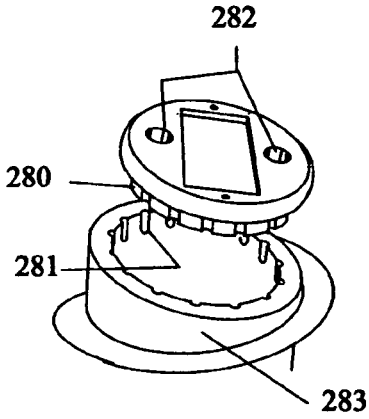

FIG. 57 is an oblique view of the upper portion of a externally threaded screw in type Easy Inter Burial Container hull, 283, and a top, both with non-meshing striations, 280 and 281, which, with the striations filled with cement, pressed into the hull, and allowed to cure, provides the transfer of rotational force when a device such as those shown in FIGS. 55 and 59 are fitted into the flower receptacles, 282, to rotate the unit for final insertion into the receiving material, as shown in FIG. 60.

Figure 58:
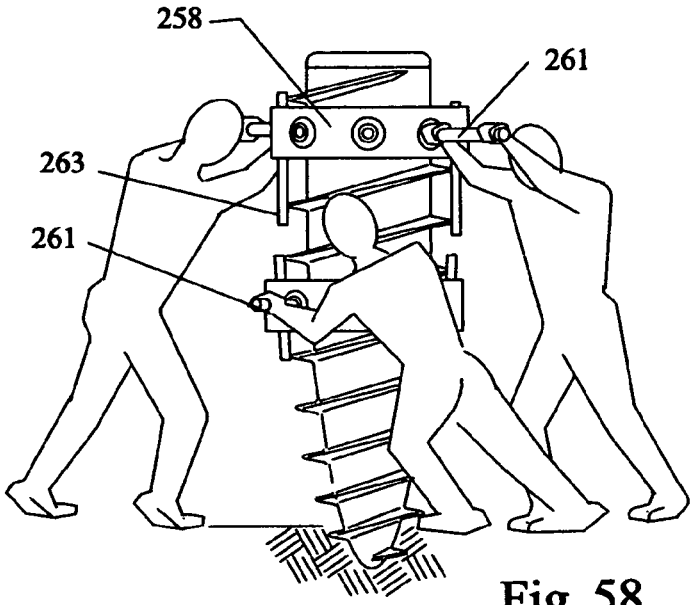

FIG. 58 is a side view of a externally threaded screw in type Easy Inter Burial Container being manually rotated into a receiving material by several persons using handles, 261, on bands, 258, as shown in FIGS. 48 and 49, with bridging sticks, 263, as shown in FIG. 50.

FIG. 59 is a oblique view of a device made with handles, 284, bolted together with hardware, 285, and driver protrusions or studs, 286, made to fit into the flower receptacle holes of a screw in type Easy Inter Burial Container top, similar to the one shown in FIG. 57, and by the application of manual force, the container is rotated in the proper direction and is inserted into the receiving material.

FIG. 60 is a side view of persons using the device, 287, shown in FIG. 59, to finish the insertion of a screw in type Easy Inter Burial Container into receiving material.

Figure 61:
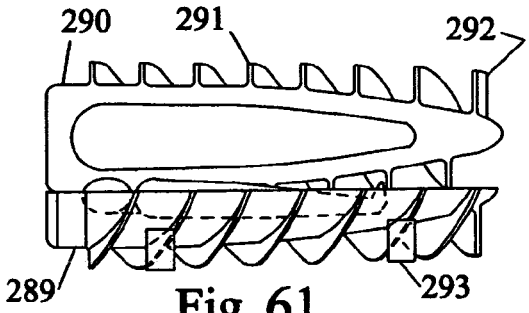

FIG. 61 depicts an externally threaded, self boring, screw in type Easy Inter Burial Container, sitting on blocks, 293, in funeral display, split lengthwise and hinged with the lid segment, 290, raised above the hull, 289, to display the contents, and showing that the external screw threads, 291, match across the split line and continue to the tapered end of the hull, 292. The drawing shows that these threads extend outward from the hull a sufficient distance to ensure that the loosened receiving material is moved upward around the hull as it is rotated in the proper direction. Note that the flat areas at the lower end of the screw in threads will act as cutting blades in softer receiving materials and can be fitted with add-on hardened blades for burials in firmer receiving materials.

Figure 62:
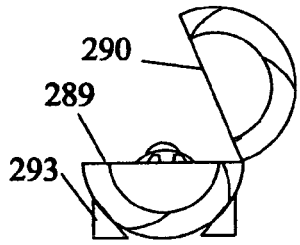

FIG. 62 is an end view of FIG. 61 showing the main or lower hull section, 289, with the lid segment, 290, open and with blocks, 293, holding the Easy Inter Burial Container in place.

Figure 63:
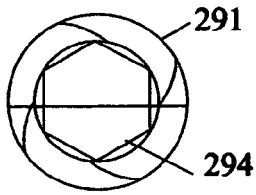
Figure 64:
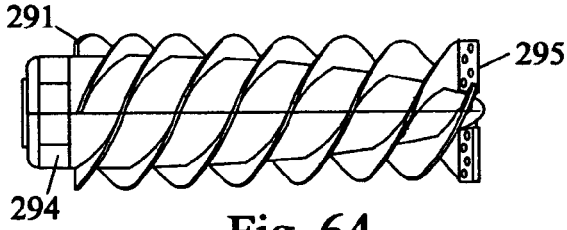

FIG. 63 is an end view of the unit in FIG. 64, in a closed position showing screw threads, 291, and the driven section, 294, in this case a hexagonal shape, by which it will be rotated into a receiving material.

FIG. 64 illustrates a side view of the Easy Inter Burial Container in FIGS. 61, 62 and 63, in a closed position with the driven section, 294, noted and showing add on cutting blades, 295, attached to the ends of the screw threads, 291.

Figure 65:
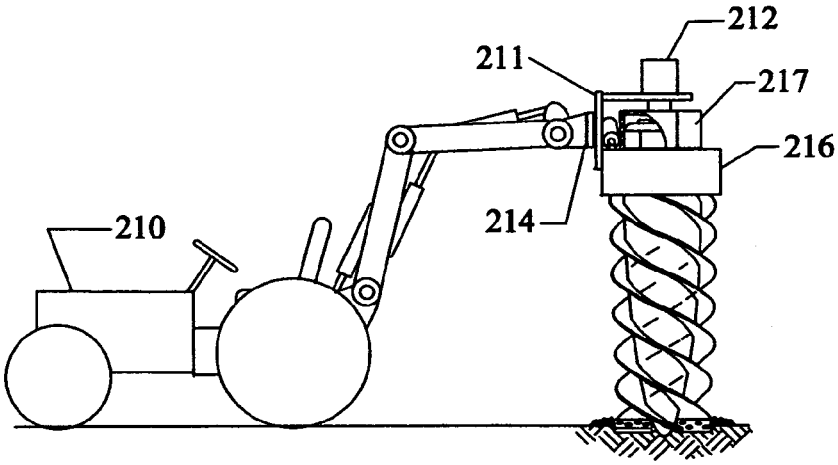

FIG. 65 is a diagram of a tractor backhoe, 210, using its rotator section, 215, angled adaptor, 211, drive motor, 212, barrel drum handler, 216 and wrench unit, 217, to install the Easy Inter Burial Container shown in FIGS. 61, 62, 63 and 64.

Figure 66:
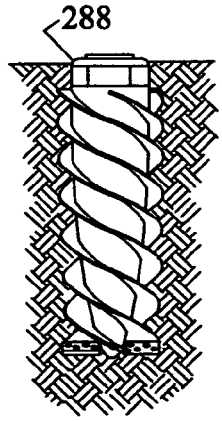

FIG. 66 depicts a Easy Inter Burial Container, such as that shown in FIG. 65, installed and having its top, 290, slightly above the surface level of the receiving material.

Figure 67:
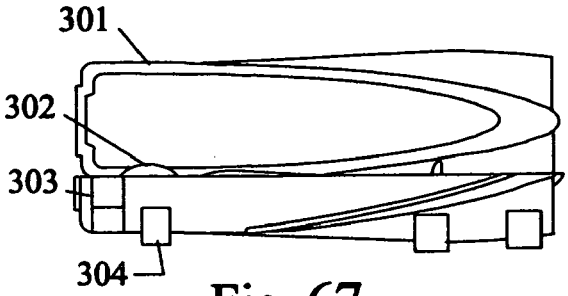

FIG. 67 is a side view of a Easy Inter Burial Container with self digging blades, the hull split lengthwise into a open, padded, upper lid segment, 301, and a lower main section, 303, as is common practice in current coffins and caskets, with a body and body tray, 302, inside, and being stabilized and held level by blocks, 304, for funeral display.

Figure 68:
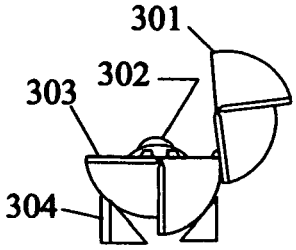

FIG. 68 is an end view of the Easy Inter Burial Container shown in FIG. 67, illustrating the positions of the raised lid segment, 301, body and body tray, 302, lower main section, 303, and the support blocks, 304.

Figure 69:
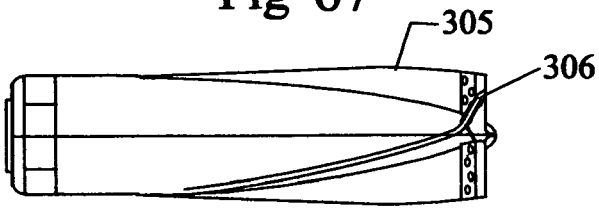

FIG. 69 is a side view of the Easy Inter Burial Container in FIG. 67, except in its closed position showing cutting blade extensions, 305, which guide the cut away receiving material to the surface, and added on cutting blades, 306.

Figure 70:
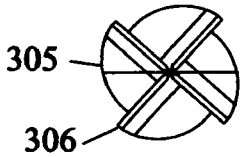

FIG. 70 is and end view of the Easy Inter Burial Container in FIG. 69 showing the relationship of the cutting blade extensions, 305, and the added on cutting blades, 306.

Figure 71:
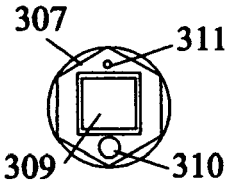
Figure 72:
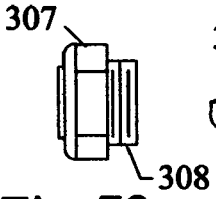
Figure 73:
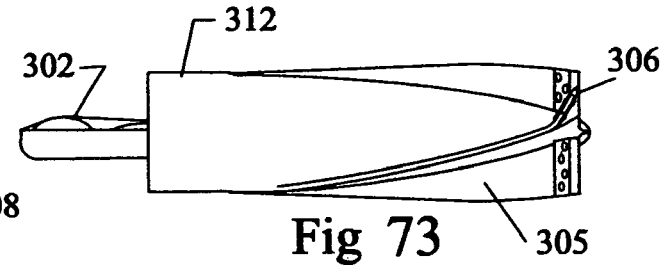

FIG. 71 is an end view of the screw in top in FIG. 72 and the matching single piece hull in FIG. 73, showing the driven flats, 307, rectangular plaque or monument area, 309, flower receptacle, 310 and flag holder, 311.

FIG. 72 is a side view of the screw in top, which fits the hull depicted in FIG. 73, pointing out its driven flats, 307 and the threads, 308, to match those inside the hull.

FIG. 73 is a side view of a single piece, non-split hull, 312, with a body and body tray, 302. Note that the hull has cutting blade extensions, 305, and added on cutting blades, 306, for self digging and movement of loosened receiving material to the surface.

Figure 74:
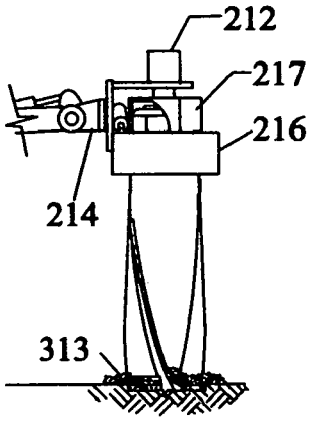

FIG. 74 is a side view of a Easy Inter Burial Container with cutting blades and cutting blade extensions being held by a barrel drum handler, 216, on the end of a tractor backhoe arm, 214, and rotated by a socket wrench, 217, which is in turn rotated in the correct direction by a drive motor, 212. Note the removed receiving material, 313, around the start of the hole.

Figure 75:
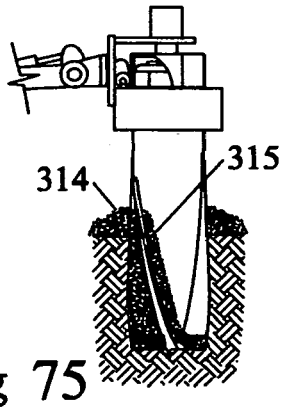

FIG. 75 is a cut away side view of the self digging Easy Inter Burial Container in FIG. 74, having dug into the receiving material with some dug away receiving material, 314, outside of the hole and additional dug away material, 315, being forced upward and out by the cutting blade extensions.

Figure 76:
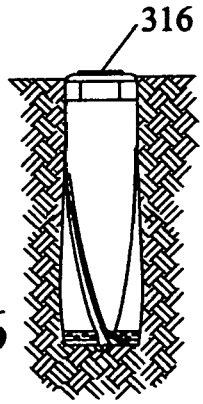

FIG. 76 is a cut away side view of the self digging unit in FIG. 75, now fully installed, showing its top, 316, and its final positioning after the receiving material around the hull has been tamped and the surplus removed.

Figure 77:
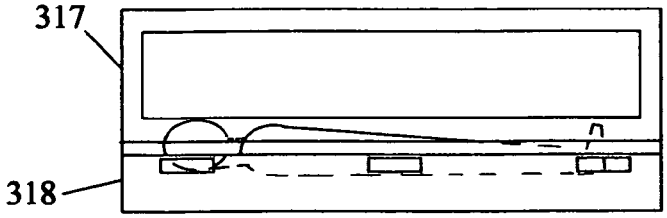

FIG. 77 is a depiction of a Easy Inter Burial Container made to look like a conventional casket with its padded upper lid, 317, and body fitting lower section, 318. The internal shape of the lower section, 318, is made to the shape of a human body and padded, while the inside of the upper lid, 317, is heavily padded to securely retain the body in position when closed.

Figure 78:
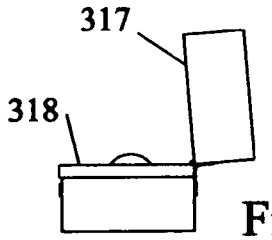

FIG. 78 is an end view of the Easy Inter Burial Container shown in FIG. 77, with its upper lid, 317, and its lower section, 318, denoted.

Figure 79:
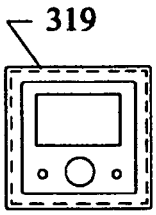

FIG. 79 is an end view of the Easy Inter Burial Container in FIGS. 77 and 78 with an added on top cap, 319, in place.

Figure 80:
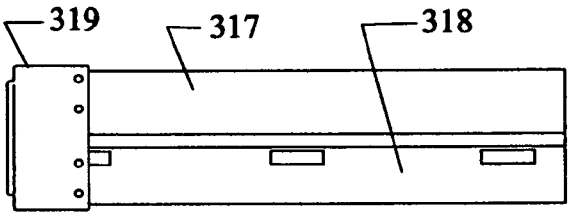
Figure 82:
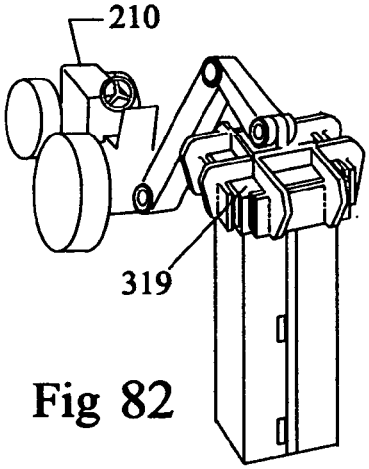

FIG. 80 is a side view of FIG. 79, with the top cap, 319, fastened to and over the upper lid, 317, and the lower section, 318, to not only provide a plaque-marker when interment is complete, but to provide closure security and a grip for the handling apparatus shown in FIG. 82.

Figure 81:
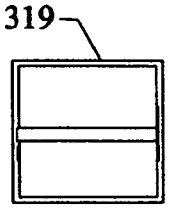

FIG. 81 is an end view of FIG. 80, showing the Easy Inter Burial Container in a closed position, with the top cap, 319, at the far end of the view.

Figure 83:
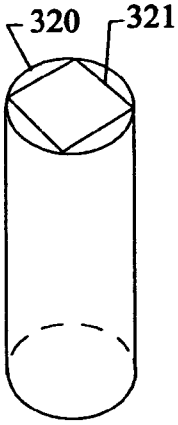
Figure 84:
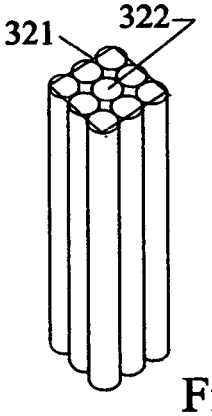

FIG. 82 shows a tractor backhoe, 210, with a gripping device on the end of its arm holding the top cap, 319, of the Easy Inter Burial Container of FIGS. 79, 80 and 81 in an erect position for insertion into one of the pre-dug holes shown in FIGS. 83 and 84.

FIG. 83 shows a round pre-dug hole with the hole diameter, 320, and the outside dimensions, 321, of such a Easy Inter Burial Container, as shown in FIG. 79, marked.

FIG. 84 illustrates how a number of smaller holes, 322, can be bored in a receiving material to accommodate the dimensions, 321, of such a Easy Inter Burial Container as shown in FIG. 79.

Figure 85:
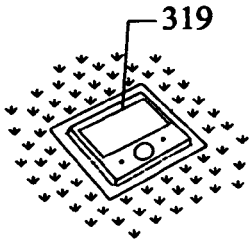

FIG. 85 is a view of the Easy Inter Burial Container of FIG. 82 installed in a receiving material and showing only its top cap, 319.

Figure 86:
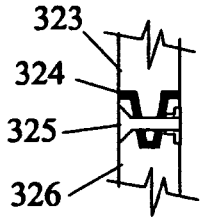

FIG. 86 is cross sectional view of the joint of a typical upper, 323, and lower section, 326, of a casket like Easy Inter Burial Container pointing out the gasket seal, 324, and one of the through joint counter sunk screw and nut assemblies, 325.

Figure 87:
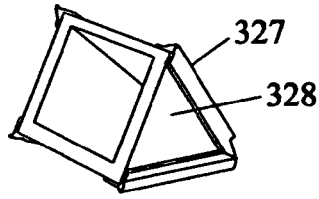
Figure 88:
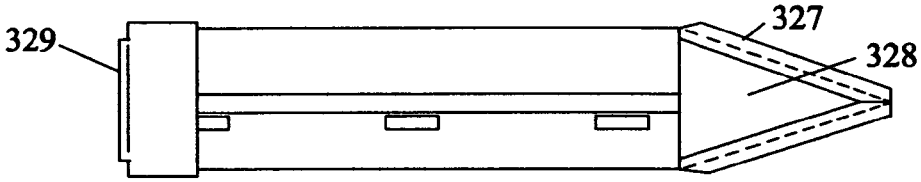

FIG. 87 shows a pyramidal nose piece, 328, to be placed on a square cross section casket like Easy Inter Burial Container, as shown in FIG. 88, to provide closure of the casket and a digging point for the unit. Also shown are the optionally added cutting edges, 327, for use in firmer receiving materials.

Figure 90:
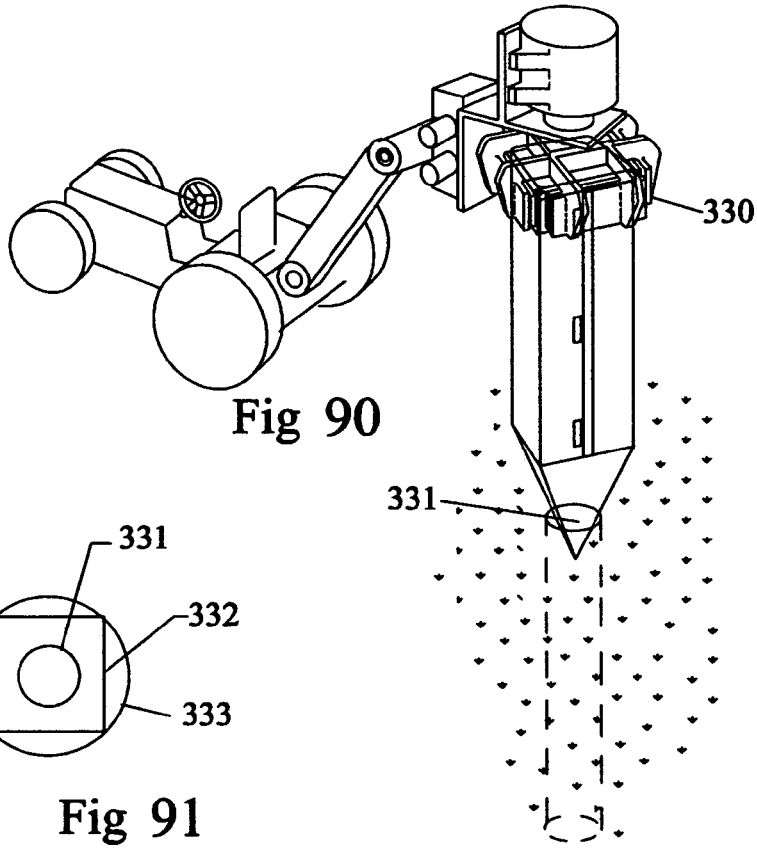

FIG. 88 is a side view of a Easy Inter Burial Container with a nose piece, 328, and optional cutting edges, 327, at the right hand end and a end cap, 329, added to the left hand end, which provides a driven section for the driver device shown as 330 in FIG. 90.

Figure 89:
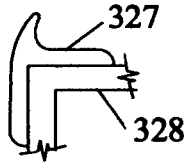

FIG. 89 is a cross section cut-away of a typical optional cutting edge, 327, attached to a corner formed by the juncture of two sides of a pyramid shaped nose piece, 328.

FIG. 90, shows a tractor backhoe using a square section clamping drive head, 330, to hold, rotate and press an Easy Inter Burial Container, as that shown in FIG. 88, into a pre-bored or augered hole, 331.

Figure 91:
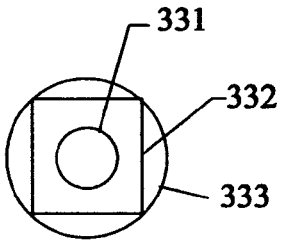

FIG. 91 illustrates the relationship of the original pre-bored or augered hole, 331, the square section of the Easy Inter Burial Container, 332, as shown in FIG. 88, and the circle and thus sidewall of the finished hole, 333, caused by the action of the corners of the Easy Inter Burial Container and or the optional added on cutting blades, 337, in FIGS. 88 and 89, as the unit is rotated in the correct direction.

Figure 92:
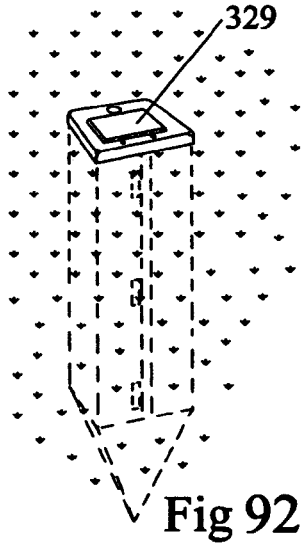

FIG. 92 is of the finished installation of the Easy Inter Burial Container shown in FIG. 90, with only its end cap, 329, showing and with the nose piece having bored its way into the bottom of the pre-bored or augered hole and the displaced receiving material settled and tamped into the former spaces between the hole and the sidewalls of the Easy Inter Burial Container.

FIG. 93 is that of a currently used type of casket with a lower section, 335, and an upper section, 334, which acts as a lid, shown in funeral service display position.

FIG. 94 is an end view of the casket shown in FIG. 93, with its lid or upper section, 334, in the open position above the lower section, 335.

FIG. 95 illustrates how the casket in FIGS. 94 and 95, with upper section, 334, and lower section, 335, closed and secured is inserted into a larger size Easy Inter Burial Container main hull, 338, with its cap, 336, ready for final closure.

FIG. 96 is a diagram of a tractor backhoe, 210, rotating the driven lands on the top of the hull and inserting the Easy Inter Burial Container, 338, containing the conventional, currently used, casket in FIG. 95, into a pre-augered pilot hole, 338.

FIG. 97 is a cut away side view of the Easy Inter Burial Container of FIG. 96, in its final position as a finished grave, with its cap, 336, barely showing above the mounded up receiving material, 339.

Figure 98:
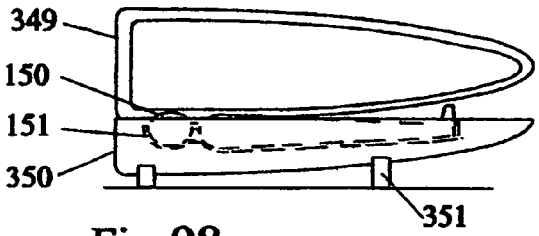

FIG. 98 is a side view of a smooth sided Easy Inter Burial Container being used in a current type funeral service with its padded lid or upper section, 349, in the open position and the body fitting main or lower section, 350, resting on blocks, 351, and showing a body, 150, resting inside of a body tray, 151.

Figure 99:
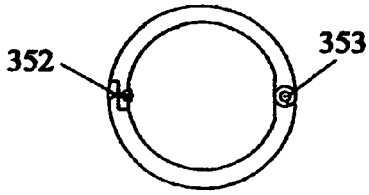

FIG. 99 is a cross section of the Easy Inter Burial Container in FIG. 98, showing its overlapping closure joint, 352, and its hinge, 353.

Figure 100:
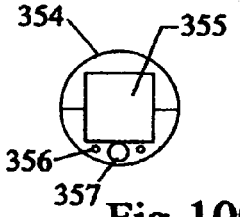

FIG. 100 is an end view of the Easy Inter Burial Container, 354, as shown in FIG. 98, excepting that it is in the closed position and shows a marker plaque, 355, attached over the joint and covering the top or larger end to provide additional locking security and also showing a flower receptacle, 357, and a flag receptacle, 356.

Figure 101:
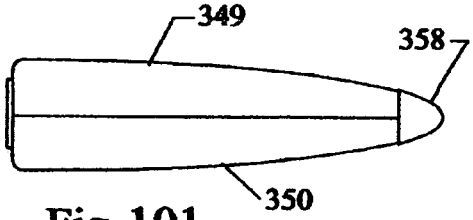

FIG. 101 is a side view of the closed Easy Inter Burial Container shown open in FIG. 98, with lid or upper section, 349, closed against the body fitting main or lower section, 350, and having a nose piece, 358, in place, providing extra closure security.

Figure 102:
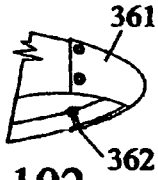

FIG. 102 is a detail of a nose piece, 361, with through hull attachment hardware, 362.

Figure 103:
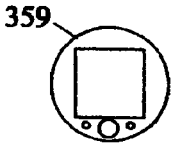

FIG. 103 is an end view of a screw in top cap, 359, for a smooth hull Easy Inter Burial Container.

Figure 104:
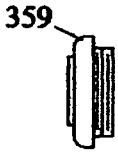

FIG. 104 is a side view of the screw in top cap, 359, shown in FIG. 103.

Figure 105:
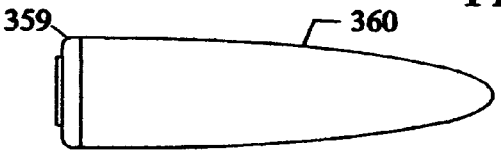

FIG. 105 is a side view of a non-split, single piece smooth hull Easy Inter Burial Container, 360, having its screw in top cap, 359, in place.

Figure 106:
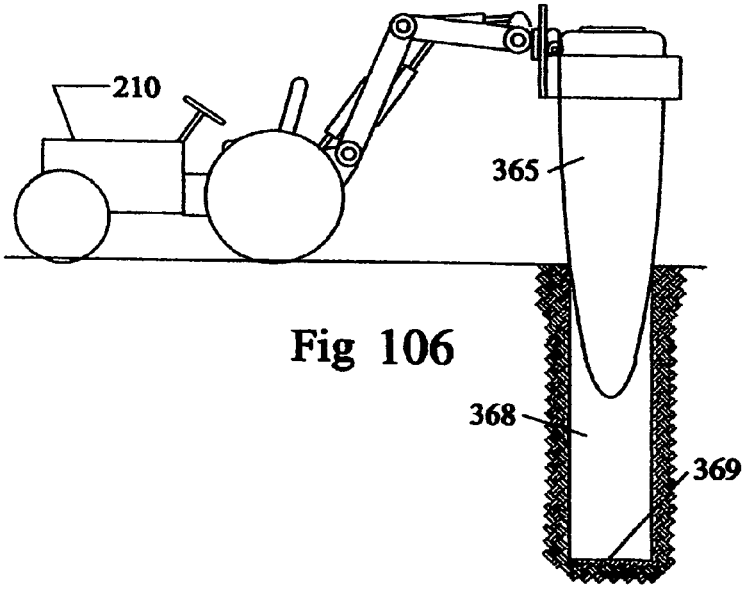

FIG. 106 illustrates the arrangement whereby a tractor backhoe with a barrel drum handler, grips an Easy Inter Burial Container, 365, similar to those shown in FIGS. 101 and 105, and presses it downward into the pre-augered hole, 368, while agitating it back and forth and side to side to cause a firm fit into the receiving material, including a displacement into the bottom of the hole, 369.

Figure 107:
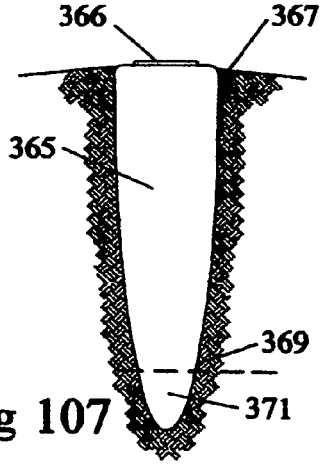

FIG. 107 shows the Easy Inter Burial Container, 365, of FIG. 106, in its final position, with its plaque and top, 366, at the top of the slight mound, 367, created by the displacement of the receiving material and having its nose, 371, worked into the bottom of the pre-augered hole, 369

Figure 108:
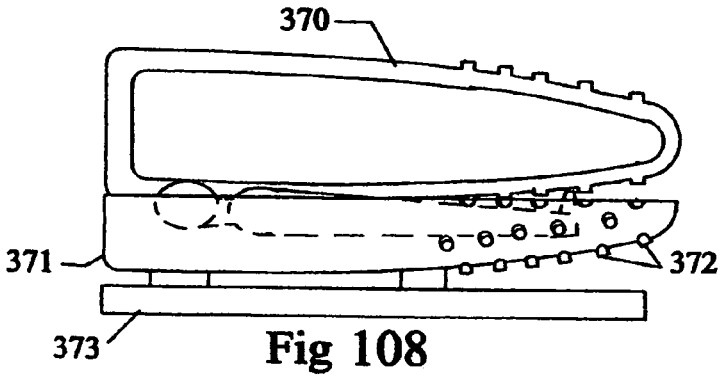

FIG. 108 is a side view of a Easy Inter Burial Container having harder receiving material break up protrusions, 372, with its upper section, 370, raised in an open position to display the contents of the lower section, 364, which is resting on a blocked palldrum handler gripping the Easy Inter Burial Container, 376, as the one shown in FIG. 108 or the one shown in FIG. 1 et, 373, for a funeral service.

Figure 109:
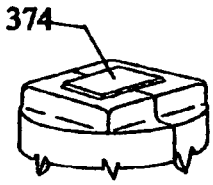

FIG. 109 is an oblique view of the upper section of the Easy Inter Burial Container in FIG. 108, showing a marker plaque, 374, in place for closure security and later grave site viewing by visitors.

Figure 110:
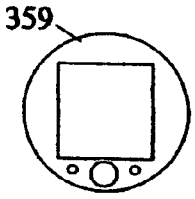

FIG. 110 is an end view of a screw in top cap, 359, the same as in FIG. 103, showing a flat area for a plaque, marker or monument, a flower receptacle and a flag holder.

Figure 111:
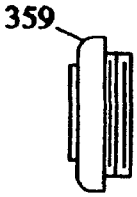
Figure 112:
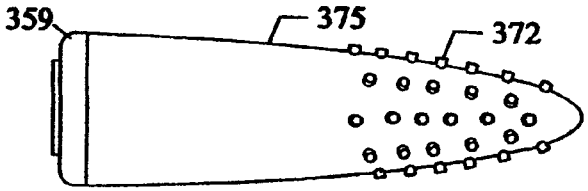

FIG. 111 is a side view of the top cap, 359, shown in FIG. 110 in position to be installed in a non-split, single piece hull as shown in FIG. 112.

FIG. 112 is a side view of a non-split, single piece Easy Inter Burial Container hull, 375, with protrusions, 372, similar to those on the split unit in FIG. 108, and its top cap, 359.

Figure 113:
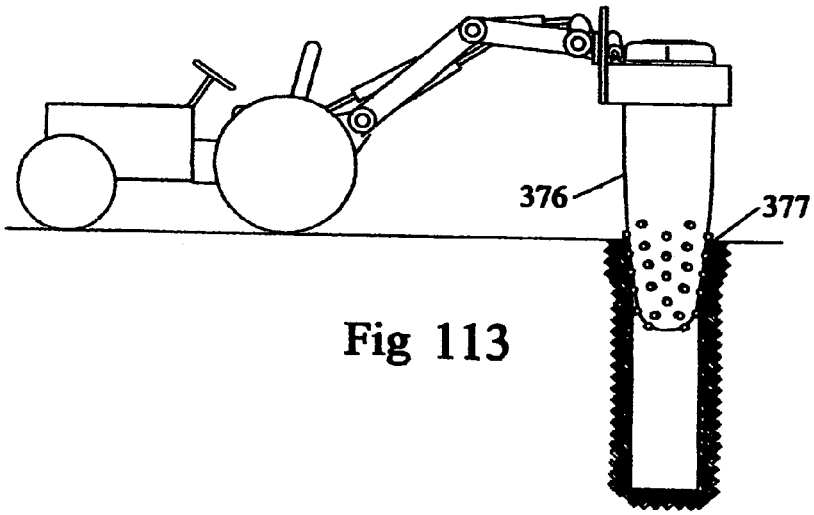

FIG. 113 shows a tractor backhoe with an arm and barrel drum handler gripping the Easy Inter Burial Container, 376, as the one shown in FIG. 108 or the one shown in FIG. 112, and agitating and pressing it down into a hole, 377.

Figure 114:
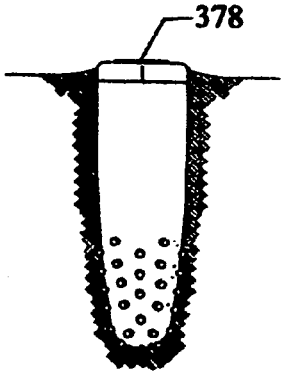

FIG. 114 illustrates the Easy Inter Burial Container from FIG. 113 in its final buried position, having been agitated and pressed down through the bottom of the pre-augered hole, with only its top and plaque, 378, visible above the receiving material.

Figure 115:
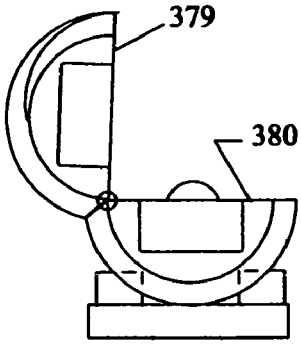

FIG. 115 is an end view of a horizontally split and hinged screw-in type Easy Inter Burial Container with its lid or upper section, 379, in the open position, allowing viewing of the contents in the lower section, 380.

Figure 116:
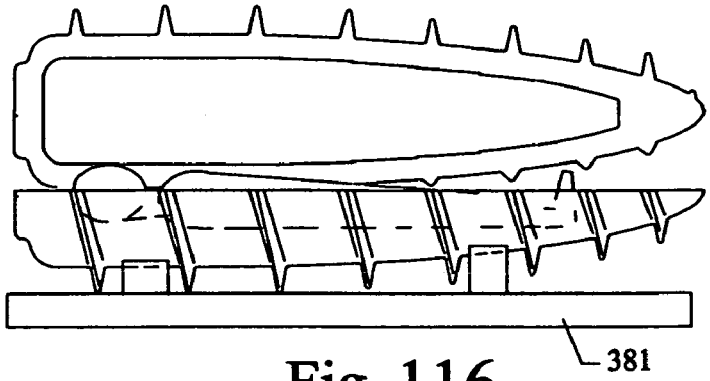

FIG. 116 is a side view of the same horizontally split and hinged screw-in type Easy Inter Burial Container as shown in FIG. 115, resting on a frame with blocks, 381, for an open casket funeral service.

Figure 117:
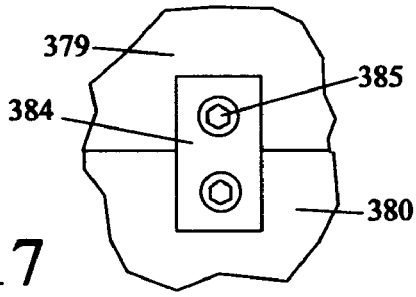

FIG. 117 is an enlarged view of a closure plate, 384, and attachment hardware, 385, used at the juncture of the upper section, 379, and lower section, 380, of the Easy Inter Burial Container shown in FIG. 116, used to ensure structural security during installation into a receiving material.

Figure 118:
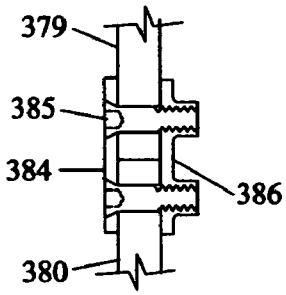

FIG. 118 is a cross section cut away through FIG. 117, showing the outside closure plate, 384, the flush head hex screw, 385, and the inside nut plate, 386, used to secure the juncture between the upper, 379, and lower, 380, sections of the burial container.

Figure 119:
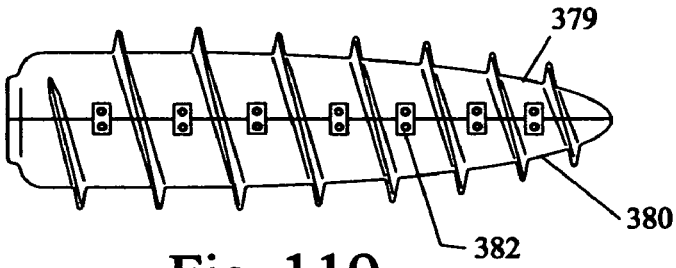

FIG. 119 is a side view of the Easy Inter Burial Container in FIG. 116, but now in a closed position with a number of closure plates, 382, securely holding the upper, 379 and lower, 380, sections together.

Figure 120:
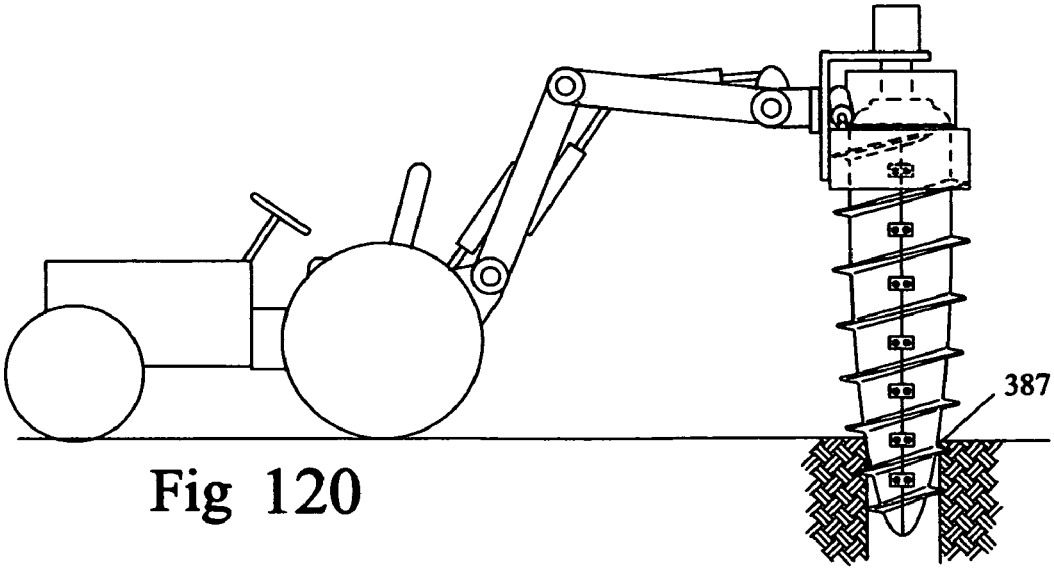

FIG. 120 is a side view drawing of a tractor backhoe with the same arm and power accessories as shown in FIGS. 28, 29 and 30, installing the Easy Inter Burial Container shown in FIG. 119, into a pre augered pilot hole, 387.

Figure 121:
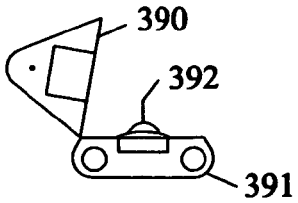

FIG. 121 is and end view of a triangular cross section Easy Inter Burial Container, split lengthwise and hinged, with its lid or upper section, 390, in the open position and its lower or main hull section, 391, containing a body, 392.

Figure 122:
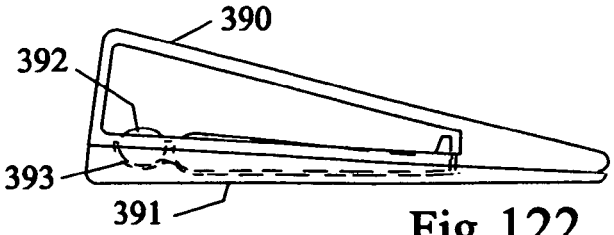

FIG. 122 is a side view of the Easy Inter Burial Container in FIG. 121, also with its upper section, 390, open and its main or lower section, 391, containing a body, 392, which is resting in a form fitting body tray, 393, within the burial container and showing a taper from the head section to the foot section.

Figure 123:
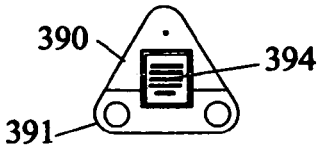

FIG. 123 is an end view of the unit shown in FIG. 121, except with its upper section, 390, closed down against its main or lower section, 391, and showing the grave marker plaque, 394, covering the closure line and acting as additional closure security and which will show at ground level when the Easy Inter Burial Container is installed.

Figure 124:
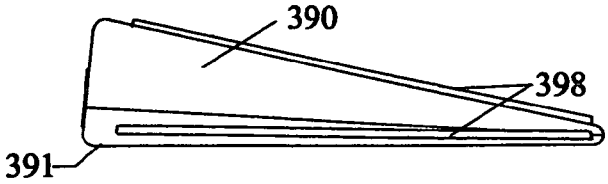

FIG. 124 is a side view of the closed Easy Inter Burial Container in FIG. 123, with its upper section, 390, and its lower section, 391, indicated and with added on cutting blades, 398, attached along the junctures of its sides. See FIG. 129 for detail.

Figure 125:
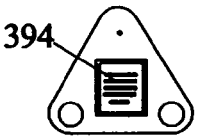

FIG. 125 is an end view of a Easy Inter Burial Container, similar in its triangular cross section to the one depicted in FIG. 121, except being of the non-split, single piece hull design with a top cap. It also shows as having a marker plaque, 394.

Figure 126:
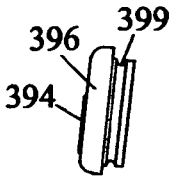
Figure 127:
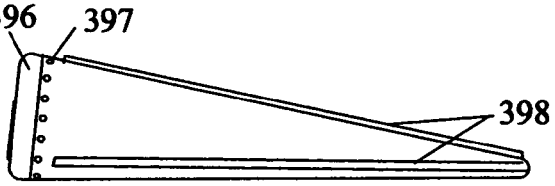

FIG. 126 is a side detail of a Easy Inter Burial Container top cap, 396, with a marker plaque, 394, and a security groove, 399, in the area made to fit inside a triangularly shaped, single piece hull, as shown in FIG. 127.

FIG. 127 is a side view of a non-split, single piece hull, with its top cap, 396, from FIG. 126, in place and a series of metal fasteners, 397, around the larger end of the hull, locking the top in place by their intrusion into the groove shown as 399 in FIG. 126. Also indicated are added on cutting blades, 398, similar to those detailed in FIG. 129.

Figure 128:
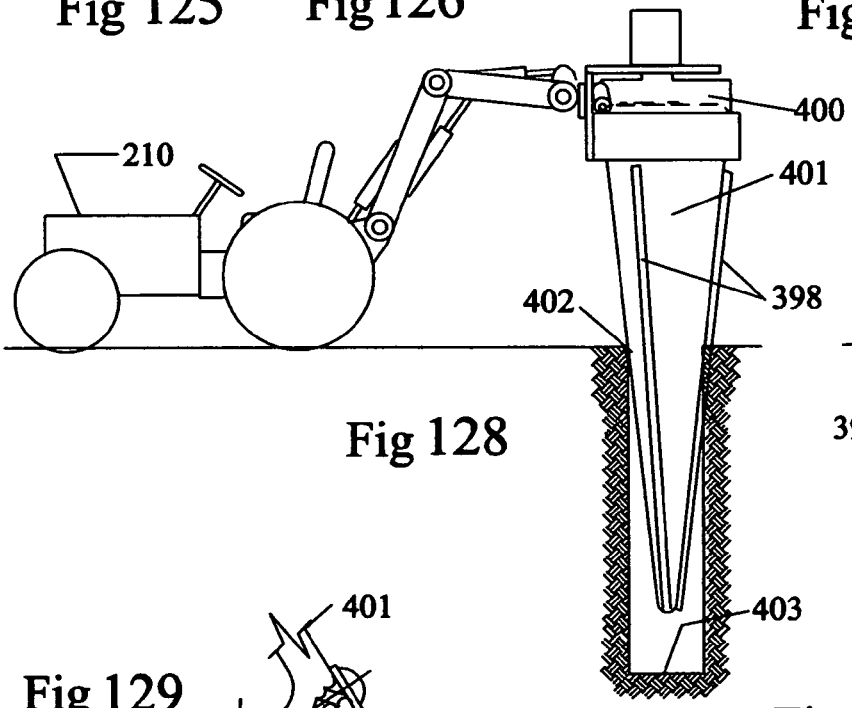

FIG. 128 is a side view of a tractor backhoe installing a triangular cross section Easy Inter Burial Container, 401, of either of the types shown in FIG. 124 or FIG. 127, by rotating it with a triangle shaped and powered wrench, 400, into a pre-dug pilot hole, 402, where its cutting blades, 398, are just beginning to remove receiving material, cutting its way and penetrating through the bottom of the pilot hole, 403.

Figure 129:
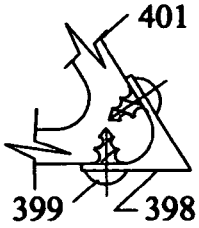

FIG. 129 is an enlarged cross section of a corner of a triangular cross section Easy Inter Burial Container hull, 401, showing the metal fasteners, 399, and attachment of a added on cutting blade, 398.

Figure 130:
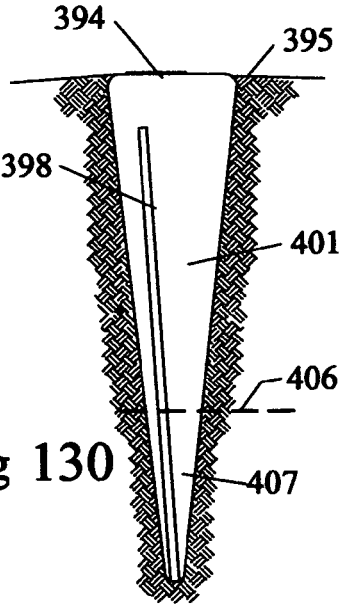

FIG. 130 is a cut away of the receiving material showing the final, installed position of the Easy Inter Burial Container, 401, from FIG. 128, after it has been rotated sufficiently to have its cutting blades, 398, widen the original pilot hole and bore through the bottom line, 406, of the original hole and settle a portion of the unit, 407, through the bottom of the hole, leaving only the marker plaque, 394, showing through the surrounding receiving material, 395.

FIG. 131 is a end view of a pentagon cross section shaped Easy Inter Burial Container, made to look somewhat like a conventional casket, except tapered for later easy installation into receiving materials, showing its upper or lid section, 408, and its lower or main section, 409, in open position, as in an open casket funeral service.

FIG. 132 is a side view of the unit shown in FIG. 131, with its upper section, 408, in an open position above its lower or main section, 409, which illustrates the tapered nature of this type of Easy Inter Burial Container.

FIG. 133 is an end view of the same unit shown in FIG. 131, with its upper section, 408, closed over its lower section 409, and having a marker plaque, 410, in place to act as additional closure security and to mark the grave site after installation.

FIG. 134 is a side view of the closed Easy Inter Burial Container in FIG. 132, showing its upper section, 408, and its lower section, 409, and highlighting its added on cutter blades, 415, at the junctures of its sides. See FIG. 138.

FIG. 135 is an end view of a pentagon cross section Easy Inter Burial Container made with a non-split, single piece hull and having a top cap and a plaque, 410.

FIG. 136 is a side view of a pentagon shaped top cap, 412, made to fit into and become a part of the unit shown in FIG. 137, highlighting the groove, 413, into which attachment hardware will fit through the hull and secure the top.

FIG. 137 is a side view of a single piece hull, 423, with top cap, 414, Easy Inter Burial Container showing its top cap attachment hardware, 417, and added on cutting blades, 415, which are not necessary in softer receiving materials, but speed up installation is firmer materials.

FIG. 138 is a cross section of a corner of a Easy Inter Burial Container hull, 408, onto which add on cutting blades, 415, have been attached with metal fasteners, 430.

FIG. 139 is a side view of a tractor backhoe using a drive motor, 426, and a five sided wrench, 427, to install a pentagon cross section Easy Inter Burial Container as shown in FIG. 134 or FIG. 137, with the main hull, 428, inserted into a pre-augered hole, 431, and highlighting the bottom of the original hole, 432, through which the lower, tapered end of the main hull will penetrate.

FIG. 140 is a cut away view of the main hull, 428, in FIG. 139 after it has been fully installed with its lower, tapered end, 436, penetrating the receiving material below the bottom line, 435, of the original hole and indicating its visible top portion, 433, after installation and the slight rise, 434, around the unit.

I claim:

1. A burial container for interment of a deceased comprising:

a hull having a length, an open first end, a closed second end, an outer surface, and an interior for receiving the deceased, the outer surface tapering along the length from the first end to the second end such that the outer periphery of the hull is larger at the first end and smaller at the second end; the outer surface including external threads extending helically thereabout and substantially the entire length of the hull;

a cap removably secured to the first open end of the hull to sealingly close the hull, the cap including means for displaying items of memorialization thereon; and at least one of the cap and hull including means for engagement with an external device, the external device cooperating with the at least one of the cap and hull to rotate the burial container such that the external threads pull the burial container into the ground for interment of the deceased.

2. A burial container for interment of a deceased as claimed in claim 1, further comprising a tray for supporting the deceased thereon and for placement within the hull interior.

3. A burial container for interment of a deceased as claim in claim 2, further comprising a shroud secured to the tray whereby the tray and shroud collectively define a closed chamber for the deceased.

4. A burial container for interment of a deceased comprising:

a hull having a length, a first end, a second end, an outer surface, and an interior for receiving the deceased, the hull being split along at least a portion of its length to define a lower section and an upper section hingedly connected thereto, the upper section movable between a closed position and an open position for placement of the deceased in the interior of the hull, the outer surface tapering along the length from the first end to the second end such that the outer periphery of the hull is larger at the first end and smaller at the second end; the outer surface including external threads extending helically thereabout and substantially the entire length of the hull;

the first end of the hull including means for displaying items of memorialization thereon; and the first end of the hull including means for engagement with an external device, the external device cooperating with the first end of the hull to rotate the burial container such that the external threads pull the burial container into the ground for interment of the deceased.

5. A burial container for interment of a deceased as claimed in claim 4, further comprising a tray for supporting the deceased thereon and for placement within the hull interior.

6. A burial container for interment of a deceased as claim in claim 5, further comprising a shroud secured to the tray whereby the tray and shroud collectively define a closed chamber for the deceased.

* * * * *